US008731431B2

(12) United States Patent
Sugiura et al.

(10) Patent No.: US 8,731,431 B2
(45) Date of Patent: May 20, 2014

(54) BELT DEVICE AND IMAGE FORMING APPARATUS INCORPORATING SAME HAVING A CLEANING DEVICE WHICH CLEANS UTILIZING DIFFERENT POLARITIES

(75) Inventors: Kenji Sugiura, Yokohama (JP); Osamu Naruse, Yokohama (JP); Naomi Sugimoto, Kawasaki (JP); Hisashi Kikuchi, Kawasaki (JP); Yoshiki Hozumi, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 743 days.

(21) Appl. No.: 12/913,335

(22) Filed: Oct. 27, 2010

(65) Prior Publication Data

US 2011/0103822 A1 May 5, 2011

(30) Foreign Application Priority Data

Oct. 29, 2009 (JP) ..... 2009-248415
Aug. 26, 2010 (JP) ..... 2010-189096

(51) Int. Cl.
*G03G 15/16* (2006.01)

(52) U.S. Cl.
CPC ..... *G03G 15/161* (2013.01); *G03G 2215/1661* (2013.01)
USPC ..... 399/101; 399/353; 399/354

(58) Field of Classification Search
CPC ..... G03G 15/161
USPC ..... 399/101, 123, 353, 354
See application file for complete search history.

(56) References Cited

U.S. PATENT DOCUMENTS

| | | | |
|---|---|---|---|
| 5,260,754 | A | 11/1993 | Yano et al. |
| 5,386,274 | A | 1/1995 | Sanpe et al. |
| 5,526,100 | A | 6/1996 | Misago et al. |
| 5,592,267 | A | 1/1997 | Misago et al. |
| 6,799,012 | B2 | 9/2004 | Shakuto et al. |
| 6,847,792 | B2 | 1/2005 | Nakafuji et al. |
| 6,987,944 | B2 | 1/2006 | Shakuto et al. |
| 7,058,330 | B2 | 6/2006 | Nakafuji et al. |
| 7,062,212 | B2 | 6/2006 | Naruse et al. |
| 7,103,301 | B2 | 9/2006 | Watanabe et al. |

(Continued)

FOREIGN PATENT DOCUMENTS

| | | |
|---|---|---|
| JP | 2002-72709 | 3/2002 |
| JP | 2007-57803 | 3/2007 |

(Continued)

*Primary Examiner* — David Gray
*Assistant Examiner* — Laura Roth
(74) *Attorney, Agent, or Firm* — Oblon, Spivak, McClelland, Maier & Neustadt, L.L.P.

(57) ABSTRACT

A belt device incorporatable in an image forming apparatus includes an endless belt, multiple belt tension rollers disposed in contact with an inner surface of the endless belt, a rotary cleaning member to contact a belt wound area of the endless belt facing an opposing roller to form a cleaning nip between the rotary cleaning member and the endless belt and rotate the rotary cleaning member in a direction opposite the belt moving direction within the cleaning nip, and a voltage applier. The cleaning nip is formed by offsetting a center of the cleaning nip upstream from a center of the belt wound area of the endless belt in the belt moving direction and by at least contacting the rotary cleaning member in a range from the belt wound area to a tensioned belt area located upstream from the belt wound area in the belt moving direction.

10 Claims, 12 Drawing Sheets

(56) References Cited

U.S. PATENT DOCUMENTS

| | | | | |
|---|---|---|---|---|
| 7,123,872 | B2 | 10/2006 | Shakuto et al. | |
| 7,184,699 | B2 | 2/2007 | Naruse et al. | |
| 7,209,699 | B2 | 4/2007 | Yamaguchi et al. | |
| 7,251,429 | B2 | 7/2007 | Nakafuji et al. | |
| 7,369,807 | B2 | 5/2008 | Naruse et al. | |
| 7,376,380 | B2 | 5/2008 | Koike et al. | |
| 7,415,236 | B2 | 8/2008 | Nakano et al. | |
| 7,415,238 | B2 | 8/2008 | Watanabe et al. | |
| 7,496,324 | B2 | 2/2009 | Sugiura et al. | |
| 7,505,728 | B2 | 3/2009 | Yamaguchi et al. | |
| 7,603,071 | B2 | 10/2009 | Sugiura et al. | |
| 7,610,008 | B2 | 10/2009 | Watanabe et al. | |
| 7,620,357 | B2 | 11/2009 | Shakuto et al. | |
| 2005/0036805 | A1* | 2/2005 | Murakami et al. | |
| 2005/0058474 | A1 | 3/2005 | Watanabe et al. | |
| 2006/0171735 | A1 | 8/2006 | Hamada et al. | |
| 2007/0230993 | A1* | 10/2007 | Takeuchi | 399/101 |
| 2008/0253815 | A1* | 10/2008 | Yano et al. | 399/353 |
| 2008/0286020 | A1 | 11/2008 | Watanabe et al. | |
| 2009/0176669 | A1 | 7/2009 | Sugiura et al. | |
| 2009/0232536 | A1* | 9/2009 | Nishimura et al. | 399/101 |
| 2010/0034549 | A1 | 2/2010 | Nakamatsu et al. | |

FOREIGN PATENT DOCUMENTS

| | | | |
|---|---|---|---|
| JP | 2007-72411 | | 3/2007 |
| JP | 2009-20249 | | 1/2009 |
| JP | 2009-92955 | | 4/2009 |
| JP | 4312401 | | 5/2009 |
| JP | 2010139902 | A * | 6/2010 |

* cited by examiner

BELT DEVICE AND IMAGE FORMING APPARATUS INCORPORATING SAME HAVING A CLEANING DEVICE WHICH CLEANS UTILIZING DIFFERENT POLARITIES

CROSS-REFERENCE TO RELATED APPLICATIONS

The present invention claims priority pursuant to 35 U.S.C. §119 from Japanese Patent Application No. 2009-248415, filed on Oct. 29, 2009 in the Japan Patent Office, and Japanese Patent Application No. 2010-189096, filed on Aug. 26, 2010 in the Japan Patent Office, which are hereby incorporated by reference herein in their entirety.

BACKGROUND OF THE INVENTION

1. Field of the Invention

Exemplary embodiments of the present invention generally relate to a belt device and an image forming apparatus incorporating the belt device, and more particularly, to a belt device having a belt cleaning unit to clean a surface of an endless belt member in rotation by removing residual toner remaining on the surface of the endless belt member by a cleaning roller, and an image forming apparatus incorporating the belt device.

2. Description of the Related Art

In recent years, in accordance with rising demand for higher resolutions and higher image quality, toner produced by polymerization has come to be used in place of conventional toner produced by pulverization. This is because the polymerization method can uniformly confine toner particle size within a narrow range and moreover can obtain particles of high sphericity, and therefore can provide superior reproducibility of even the small dots that correspond to high resolution. On the other hand, toner produced by polymerization can be hard to remove from a cleaning target using the typical blade cleaning method employing a cleaning blade, because the very smallness and sphericity of the toner particles allow them to slip through a small gap formed between the cleaning blade and the cleaning target member.

One solution proposed in Japanese Patent Application Publication No. 2009-020249 (JP-2009-020249-A1) involves a cleaning device that uses an electrostatic cleaning method, by which even toner produced by polymerization can be removed from a cleaning target member. Specifically, the cleaning device in JP-2009-020249-A1 includes a cleaning brush roller that rotates to contact a drum-shaped image carrier that serves as a cleaning target member, a collection roller that rotates while contacting the cleaning brush roller, and a scraping blade that scrapes away residual toner while contacting the collection roller. The cleaning brush roller includes a rotatably supported roller shaft and a brush roller portion formed by multiple fibers attached to the circumferential surface of the roller shaft. A voltage for cleaning (hereinafter, "cleaning voltage") that has a polarity opposite that of a regular charging polarity of the toner is applied to the cleaning brush roller. A voltage for collecting toner (hereinafter, "collection voltage") that has the same polarity as the cleaning voltage but which is larger than the cleaning voltage is applied to the collection roller.

Residual toner that remains on a surface of an image carrier after an image transfer process is electrostatically transferred onto the brush roller part by an electrical field formed between the image carrier and the brush roller part of the cleaning brush roller while being scraped by the brush roller part of the rotating cleaning brush roller. Then, after being electrically transferred from the brush roller part of the cleaning brush roller onto the collection roller, the residual toner is scraped from the surface of the collection roller by the scraping blade. Accordingly, toner produced by polymerization can be removed more successfully by the above-described electrostatic cleaning method, compared to removal by the blade cleaning method.

However, the electrostatic cleaning method has a drawback in that it fails to clean belts as well as it cleans rollers.

The present inventors have studied the causes of the above-described problem and found that it is necessary to suppress the ripples in the belt and consequent vibration caused by slidably contacting the cleaning brush roller against the belt, which is wound around multiple tension rollers, while pressing the cleaning brush roller relatively hard against the belt for effective cleaning. For this reason, ordinarily the cleaning brush roller is contacted against the belt to form a cleaning nip not over the entire length of the belt but only at that portion of the belt where the belt winds around the tension roller, that is, where ripples in the belt and consequent vibration cannot occur.

At the same time, however, to achieve a certain level of transferability and sheet attracting ability, an image forming apparatus generally employs a belt member having some electrical resistance. To successfully clean a belt member having some electrical resistance, it is known that a certain amount of electric current for cleaning (hereinafter, "cleaning electrical current") must be sent in a path from the cleaning brush roller to a tension roller via the belt member. In the cleaning nip, however, when an excessive amount of cleaning electric current flows around toner on the surface of the belt member, an electrical charge that has a polarity opposite the regular polarity of the toner is injected, causing the toner to be charged to the opposite polarity. According to the opposite charge polarity of toner, when the belt member is cleaned, the cleaning ability can be degraded.

A detailed description is now given of the toner charged to the opposite polarity.

FIG. 1 illustrates an enlarged diagram of an example of a cleaning nip of a conventional cleaning device.

As illustrated in FIG. 1, an intermediate transfer belt 901 that serves as a belt member to rotate endlessly is wound around a roller 902 and multiple other rollers, not illustrated. The roller 902 contacts the inner surface of the intermediate transfer belt 901 over the entire circumferential area of the intermediate transfer belt 901, in an area having a belt wound width $W_1$. At the same time, a cleaning brush roller 903 contacts the outer surface of the intermediate transfer belt 901 to form a cleaning nip therebetween. An entire nip width $W_2$ is a length of the cleaning nip in the belt moving direction of the intermediate transfer belt 901 over which the cleaning brush roller 903 scrapes the residual toner from the outer surface of the intermediate transfer belt 901, and is greater than the belt wound width $W_1$.

The cleaning brush roller 903 is rotated by a driving unit, not illustrated, to rotate in a counter direction, that is, against a direction of rotation of the intermediate transfer belt 901 in the cleaning nip, and slidably contacts the outer surface of the intermediate transfer belt 901. Residual toner remaining on the outer surface of the intermediate transfer belt 901 is scraped away by the cleaning brush roller 903 to which a cleaning bias that has a polarity opposite that of toner is applied.

At both an upstream end and a downstream end of the cleaning nip, the cleaning brush roller 903 contacts a tensioned belt area of the intermediate transfer belt 901 where the intermediate transfer belt 901 is not held in contact with the roller 902. (Hereinafter, the belt wound area where the cleaning brush roller 903 contacts the belt tension area on an upstream side of the nip is referred to as an upstream tensioned nip area.) In this upstream tensioned nip area, because the cleaning brush roller 903 contacts the outer surface of the intermediate transfer belt 901 but the cleaning opposite roller 902 does not contact the inner surface of the intermediate transfer belt 901, the cleaning electrical current described above does not flow sufficiently.

By contrast, in the belt wound area where the roller 902 contacts the intermediate transfer belt 901 or in the area indicted by the belt wound width $W_1$, the cleaning electrical current can flow well. Specifically, a large amount of electrical current flows more in the vicinity of a center part of the belt wound area where the nip pressure is greatest, than at the ends of the belt wound area. Accordingly, when toner comes to the center part of the belt wound area, toner can be charged to the opposite polarity easily.

Therefore, to obtain good cleaning ability, of the entire area in the belt moving direction in the cleaning nip, it is necessary to transfer substantially all of the residual toner onto the cleaning brush roller 903 in an upstream tensioned nip area (indicated by an upstream nip width $W_3$) and in the vicinity of an entrance to the belt wound area (indicated by the belt wound width $W_1$).

However, in the vicinity of the upstream tensioned nip area indicated by the entire nip width $W_2$, only the tip parts, that is, the leading edges of fibers forming the cleaning brush roller 903 contact the intermediate transfer belt 901. It is difficult to transfer residual toner onto the fibers under the above-described condition.

The desired transfer of residual toner onto the cleaning brush roller 903 can occur when the fibers of the cleaning brush roller 903 bend at a sharp angle to the intermediate transfer belt 901 and the sides of the fibers of the cleaning brush roller 903 contact the intermediate transfer belt 901. However, as can be seen in FIG. 1, the fibers are inclined as described above only in a small area that is relatively isolated from the entrance over the upstream tensioned nip area indicated by the upstream nip width $W_3$. Further, over the entire belt wound area indicated by the belt wound width $W_1$, only in a small area near the entrance is the toner is not charged to the opposite polarity by the cleaning electrical current. As a result, residual toner left un-transferred to the cleaning brush roller 903 enters the center part of the belt wound area in the conventional cleaning device, causing cleaning failure.

It is to be noted that the cleaning brush roller 903 is used as a cleaning rotating member to explain the above-described problems. However, a structure not having a brush like the cleaning brush roller 903 can also be used to supply a relatively large amount of cleaning electrical current to the belt wound area in the cleaning nip. As a result, in the cleaning nip, the residual toner further remaining in the upstream tensioned nip area can enter the belt wound area, which is likely to cause cleaning failure.

Further, the cleaning brush roller 903 in the above-described structure applies a cleaning bias having a polarity opposite the regular charge polarity of the toner and removes the regularly charged toner from the surface of the intermediate transfer belt 901. However, a roller that applies a cleaning bias having the same polarity as the toner to the cleaning rotating member such as the cleaning brush roller 903 and removes the oppositely charged toner from the intermediate transfer belt 901 can cause the same problem.

SUMMARY OF THE INVENTION

Exemplary aspects of the present invention have been made in view of the above-described circumstances, and provide a novel belt device that can effectively clean an endless belt member.

Other exemplary aspects of the present invention provide an image forming apparatus incorporating the above-described belt device.

In one exemplary embodiment, a belt device includes an endless belt, multiple tension rollers, a rotary cleaning member, and a voltage applier. The endless belt rotates in a belt moving direction. The multiple tension rollers are disposed in contact with an inner surface of the endless belt to tension the endless belt from inside a loop into which the endless belt is formed. The rotary cleaning member contacts a belt wound area of the endless belt opposite one of the multiple belt tension rollers at an outer surface of the endless belt to form a cleaning nip between the rotary cleaning member and the outer surface of the endless belt. The rotary cleaning member rotates and moves its outer surface in a direction opposite the belt moving direction within the cleaning nip to remove residual toner remaining on an outer surface of the endless belt. The voltage applier applies a voltage for cleaning to the rotary cleaning member. A center of the cleaning nip is offset upstream from a center of the belt wound area of the endless belt in the belt moving direction. The rotary cleaning member contacts in the endless belt at least in a range from the belt wound area of the endless belt to a tensioned belt area of the endless belt located upstream from the belt wound area of the endless belt in the belt moving direction.

A center of the cleaning nip in the belt moving direction may be located in the belt tensioned are upstream from the belt wound area of the endless belt.

An extreme downstream end of the cleaning nip in the belt moving direction may be located in the vicinity of the belt wound area of the endless belt.

The multiple tension rollers may include an extreme upstream tension roller disposed upstream from and adjacent to the opposing roller disposed opposite the rotary cleaning member in the belt moving direction to press the tensioned belt area between the upstream cleaning tension roller and the opposing roller disposed opposite the rotary cleaning member against the rotary cleaning member.

The extreme upstream tension roller may include an insulating member at least partially conveying a surface of the roller.

The rotary cleaning member may include a cleaning brush roller that includes a rotational shaft for cleaning and a brush portion formed by multiple fibrous members attached to an outer circumferential surface of the rotational shaft.

Further in one exemplary embodiment, an image forming apparatus includes at least a toner image forming unit to form a toner image on a surface of an endless belt, and the above-described belt device.

The image forming apparatus may be configured to use toner containing particles having a volume-based average particle diameter from approximately 3 μm to approximately 6 μm and a distribution of from approximately 1.00 to approximately 1.40.

The image forming apparatus may be configured to use toner containing particles having a shape factor SF-1 in a range of from approximately 100 to approximately 180, and a shape factor SF-2 in a range of from approximately 100 to approximately 180.

The endless belt includes a base member including an elastic material.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
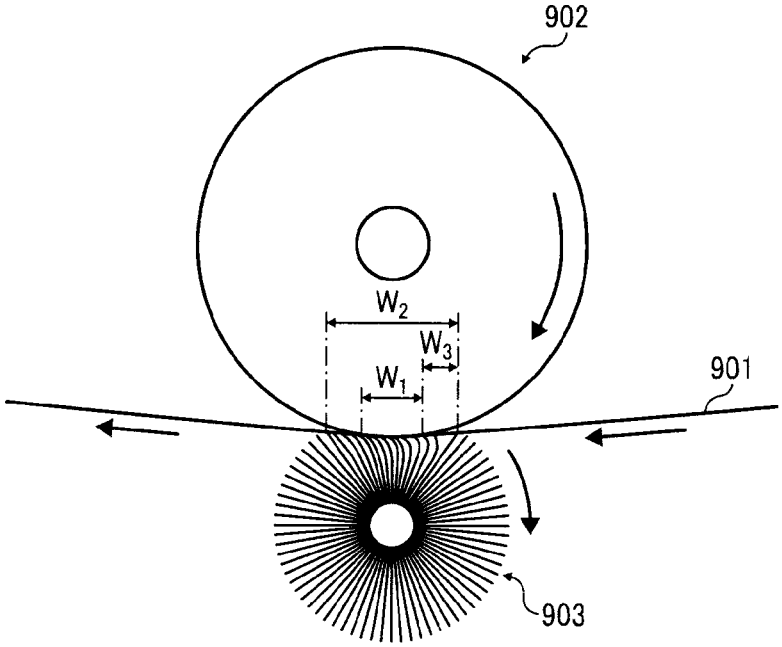
FIG. 1 BACKGROUND ART
FIG. 1 is an enlarged view illustrating a schematic configuration of a conventional cleaning unit.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present patent application.

The terminology used herein is for the purpose of describing particular embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present patent application. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present patent application.

The present patent application includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present patent application are described.

Figure 2:
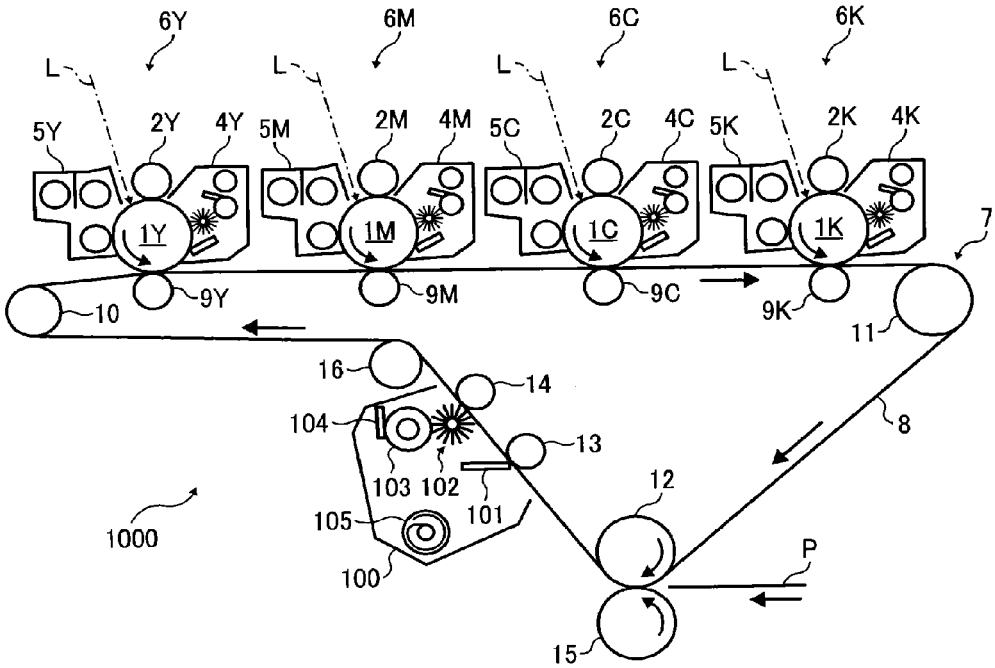
FIG. 2 is a diagram illustrating a schematic configuration of a main part of an image forming apparatus according to Exemplary Embodiment 1 of the present invention.

FIG. 2 illustrates a schematic configuration of an image forming apparatus 1000 according to an exemplary embodiment, hereinafter "Exemplary Embodiment 1" of the present invention.

The image forming apparatus 1000 can be any of a copier, a printer, a facsimile machine, a plotter, and a multifunction printer including at least one of copying, printing, scanning, plotter, and facsimile functions. In this non-limiting exemplary embodiment, the image forming apparatus 100 functions as a full-color printing machine for electrophotographically forming a toner image based on image data on a recording medium (e.g., a transfer sheet).

The toner image is formed with four single toner colors, which are yellow, cyan, magenta, and black. Reference symbols "Y", "C", "M", and "K" represent yellow color, cyan color, magenta color, and black color, respectively.

The image forming apparatus 1000 includes four process units 6Y, 6M, 6C, and 6K for generating a toner image in yellow, magenta, cyan, and black. The four process units 6Y, 6M, 6C, and 6K have drum-shaped photoconductors 1Y, 1M, 1C, and 1K, respectively. Charging devices 2Y, 2M, 2C, and 2K, developing devices 5Y, 5C, 5M, and 5K, drum cleaning devices 4Y, 4M, 4C, and 4K, a discharging unit, not illustrated, and the like are respectively arranged around the photoconductors 1Y, 1M, 1C, and 1K. Each of the process units 6Y, 6M, 6C, and 6K is structured in the same manner except that the process units 6Y, 6M, 6C, and 6K have Y toner, M toner, C toner, and K toner in colors different from each other. An optical writing unit, not illustrated, is arranged above the process units 6Y, 6M, 6C, and 6K to emit laser lights L onto surfaces of the photoconductors 1Y, 1M, 1C, and 1K and write electrostatic latent images.

A transfer unit 7 serving as a belt device is arranged below the process units 6Y, 6M, 6C, and 6K. The transfer unit 7 has an endless intermediate transfer belt 8 that serves as an endless belt. In addition to the intermediate transfer belt 8, a plurality of belt extending rollers arranged inside of a loop of the endless intermediate transfer belt 8. On the outside of the loop, a secondary transfer roller 15, a pressing roller 16, a belt cleaning unit 100, and the like are arranged.

On the inside of the loop into which the intermediate transfer belt 8 is formed, the following elements are arranged, which are four primary transfer rollers 9Y, 9M, 9C, and 9K, a tension roller 10, a primary post-transfer roller 11, a secondary transfer opposing roller 12, a polarity control opposing roller 13, and an opposing roller 14. Each of these rollers serves as a belt tension roller for winding and holding the intermediate transfer belt 8 placed around a portion of a periphery thereof to extend the intermediate transfer belt 8. The intermediate transfer belt 8 is endlessly moved in a counterclockwise direction of FIG. 2 by a rotation of the secondary transfer opposing roller 12 that serves as a drive roller rotated and driven in the counterclockwise direction of FIG. 2 by a drive unit, not illustrated.

The intermediate transfer belt 8 is sandwiched between the photoconductors 1Y, 1M, 1C, and 1K and the four primary transfer rollers 9Y, 9M, 9C, and 9K, respectively, which are arranged inside of the loop of the intermediate transfer belt 8 (hereinafter, a "belt loop"). Thus, primary transfer nips for Y, M, C, K are formed, in which an outer surface of the intermediate transfer belt 8 and the photoconductors 1Y, 1M, 1C, and 1K are held in contact with each other. Primary transfer biases having a polarity opposite to a polarity of toner are applied by power sources, not illustrated, to the primary transfer rollers 9Y, 9M, 9C, and 9K.

The intermediate transfer belt 8 is also sandwiched between the secondary transfer roller 12 arranged outside of the belt loop and the secondary transfer opposing roller 12 arranged inside of the belt loop. Thus, a secondary transfer nip is formed, in which the outer surface of the intermediate transfer belt 8 and the secondary transfer roller 12 are held in contact with each other. A secondary transfer bias having a polarity opposite to the polarity of toner is applied by a power source, not illustrated, to the secondary transfer roller 12.

The intermediate transfer belt 8 is further sandwiched between the opposing roller 14 arranged inside of the belt loop and the cleaning brush roller 102 of the belt cleaning unit 100 arranged outside of the belt loop. Thus, a cleaning nip is formed, in which the outer surface of the intermediate transfer belt 8 and a cleaning brush roller 102 are held in contact with each other. The belt cleaning unit 100 is configured to be integrally replaceable together with the intermediate transfer belt 8. However, in a case where the belt cleaning unit 100 and the intermediate transfer belt 8 have different serves life spans, the belt cleaning unit 100 may be independent from the intermediate transfer belt 8 and detachably attached to a main body of the image forming apparatus 1000. A cleaning bias having a polarity opposite to the polarity of toner used in the image forming apparatus 1000 is applied by a power source, not illustrated, which serves as a voltage applier to a cleaning brush roller 102.

The image forming apparatus 1000 includes a sheet feeding device, not illustrated, that has a sheet feeding cassette accommodating recording sheets P and a sheet feeding device, not illustrated, having a sheet feeding roller for feeding a recording sheet P to a sheet feeding path from the sheet feeding cassette. A registration roller pair, not illustrated, is arranged on the right side in FIG. 2 with respect to the aforementioned secondary transfer nip to receive a recording sheet conveyed from the sheet feeding unit and feeding the recording sheet toward the secondary transfer nip with a predetermined timing. A fixing device, not illustrated, is arranged on the left side in FIG. 2 with respect to the previously-mentioned secondary transfer nip to receive the recording sheet P conveyed from the secondary transfer nip and perform fixing processing of a toner image onto the recording sheet P. As necessary, toner supply devices for Y, M, C, and K, not illustrated, are arranged to supply Y toner, M toner, C toner, and K toner to the developing devices 5Y, 5M, 5C, and 5K.

In addition to plain paper widely used as a recording sheet in the past, a special sheet having unevenness on the surface thereof as a design and a special recording sheet used for thermal transfer such as iron print are recently often used. The above-described special sheets are more likely to cause a transfer failure than the conventional plain paper, when a toner image on the intermediate transfer belt 8 having overlapped color toners thereon is secondarily transferred onto the special sheet. Accordingly, in the image forming apparatus 1000, the intermediate transfer belt 8 has elasticity so as to improve contact with the recording sheet P.

The intermediate transfer belt 8 has a multi-layer structure.

A base layer may be made of various kinds of rubbers and synthetic resins such as polyimide, polyimideamide, polycarbonate, polyester, polypropylene including an appropriate amount of conductive agent such as carbon black, the base layer having a volume resistivity of $10^6$ Ω·cm to $10^{14}$ Ω·cm. When the intermediate transfer belt 8 has elasticity, a primary base material of a conductive elastic layer of the intermediate transfer belt 8 includes silicone rubber, NBR, H-NBR, CR, EPDM, urethane rubber, and the like.

A material of a conductive protective layer is not especially limited, as long as the material can achieve the purpose of reduction of a frictional resistance, stability against an environment of electric property, and improvement of residual toner cleaning performance caused by surface roughness reduction.

The material of the conductive protective layer may be a paint including fluorocarbon polymers such as polytetrafluoroethylene (PTFE), copolymer of tetrafluoroethylene and perfluoroalkoxyethylene (PFA), and PVDF, the paint being dissolved/dispersed in an organic solvent and emulsion of alcohol-soluble nylon, silicone resin, silane coupler, and urethane resin. These protective layers can be arranged by applying the above paints by dip-coating, spray-coating, electrostatic coating, roll coating, and the like. Further, release property, conductivity, abrasion resistance, surface cleaning property, and the like can be improved by applying surface treatment or polishing to the protective layer.

The elastic intermediate transfer belt 8 and the drum-shaped photoconductor 1 are arranged to be held in contact with each other with a relatively large belt wound area. In addition, the intermediate transfer belt 8 applies elastic pressure. Therefore, a tuck surface pressure between the drum-shaped photoconductor 1 and the intermediate transfer 8 is not so high. Moreover, the intermediate transfer belt 8 operates to wrap a toner image. Accordingly, the toner image on the photoconductors 1Y, 1M, 1C, and 1K is primarily transferred onto the intermediate transfer belt 8. At this occasion, an image transferred onto the intermediate transfer belt B has no image failure such as hollow character caused by a large tuck surface pressure, and the image is transferred with a high transfer efficiency. Therefore, a color image quality on a recording material (especially on a special sheet having unevenness and the like) is maintained at an extremely high level.

When receiving image date from a personal computer and the like, the image forming apparatus 1000 endlessly moves the intermediate transfer belt 8 by rotationally driving the secondary transfer opposing roller 12. Belt extending rollers other than the secondary transfer opposing roller 12 are rotated with the intermediate transfer belt 8. At the same time, the photoconductors 1Y, 1M, 1C, and 1K of the process units 6Y, 6M, 6C, and 6K are also rotated with the rotation of the intermediate transfer belt 8. While the surfaces of the photoconductors 1Y, 1M, 1C, and 1K are uniformly charged by the charging roller 2Y, 2M, 2C, and 2K, respectively, the laser lights L are emitted onto the charged surfaces of the photoconductors 1Y, 1M, 1C, and 1K. As a result, electrostatic latent images are formed thereon. Then, the electrostatic latent images formed on the surfaces of the photoconductors 1Y, 1M, 1C, and 1K are developed by the developing devices 5Y, 5M, 5C, and 5K, which produce Y toner image, M toner image, C toner image, and K toner image on the photoconductors 1Y, 1M, 1C, and 1K, respectively. The Y toner image, M toner image, C toner image, and K toner image are primarily transferred onto the outer surface of the intermediate transfer belt 8 in an overlapping manner, thereby forming a toner image having four overlapped colors on the outer surface of the intermediate transfer belt 8.

By contrast, the sheet feeding unit uses a sheet feeding roller, not illustrated, to feed the recording sheets P, sheet by sheet, from the sheet feeding cassette, and conveys the recording sheet P to a pair of registration rollers, not illustrated. In a timing in which the recording sheet P can be brought into synchronization with the toner image having four overlapped colors formed on the intermediate transfer belt 8, the pair of registration rollers is driven to feed the recording sheet P to the secondary transfer nip, and the toner image having four overlapped color formed on the intermediate transfer belt 8 is secondarily transferred onto the recording sheet P at a time. Thus, a full-color image is formed on a surface of the recording sheet P. The recording sheet P having the full color image formed thereon is conveyed from the secondary transfer nip to the fixing device, which fixes the toner image thereon.

Each of the drum cleaning devices 4Y, 4M, 4C, and 4K cleans residual toner remaining on the photoconductors 1Y, 1M, 1C, and 1K, from which the Y toner image, M toner image, C toner image, and K toner image have been primarily transferred onto the intermediate transfer belt 8. Thereafter, the discharging unit having a static charge eliminating lamp, not illustrated, removes electrostatic charge, and the charging devices 2Y, 2M, 2C, and 2K uniformly charge the photoconductors 1Y, 1M, 1C, and 1K, respectively, to be ready for a subsequent image forming operation.

As described above, a higher image quality is desired recently, and there is a tendency that a particle diameter of toner is reduced. Because of a desire for a reduction in production cost of toner and improvement of a transfer rate, there is a tendency that spherical toner produced by polymerization method and the like is employed instead of toner produced by pulverized method. A blade cleaning method has been primarily used as means for removing toner remaining on a surface of an image carrier, but along with the use of toner having a smaller particle diameter and made into a substantially spherical shape, a cleaning performance of the blade cleaning method is likely to decrease since such toner passes through the cleaning blade, when the accuracy of contact between the cleaning blade and the surface of the image carrier is low. If the cleaning blade is pressed with a high contact pressure in order to prevent the decrease in cleaning performance, a blade curling may occur, which causes a cleaning failure in a line or band shape, and therefore it is difficult to maintain a stable cleaning performance. When a linear pressure is increased to an extremely high level (more specifically, a linear pressure of 100 gf/cm or more), even spherical toner can be cleaned. However, the service life of the cleaning blade becomes extremely short due to abrasion of the cleaning blade, flaws or damages on the belt, and the like caused by the extremely high linear pressure. The service life of the cleaning blade with a normal linear pressure of 20 gf/cm (the service life until a cleaning failure occurs as a result of abrasion) is about 120,000 sheets. When the linear pressure is 100 gf/cm, the service life of the cleaning blade is about 20,000 sheets. It is well-known that the blade cleaning performance for cleaning spherical toner having good transfer property is lower than the cleaning performance for cleaning pulverized (atypical) toner.

Accordingly, the image forming apparatus 1000 employs the belt cleaning unit 100 that uses an electrostatic cleaning method capable of cleaning spherical toner better than the blade cleaning method.

Figure 3:
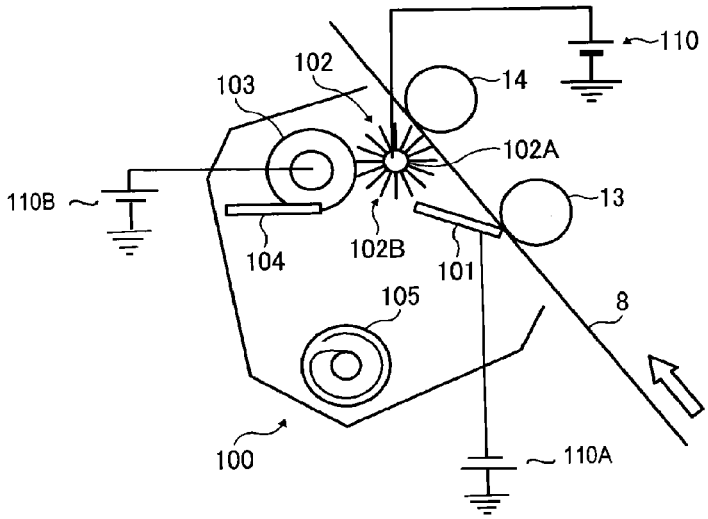
FIG. 3 is an enlarged view of a belt cleaning unit and components disposed around the belt cleaning unit.

FIG. 3 is an enlarged configuration diagram for magnifying and showing the belt cleaning unit 100 of the image forming apparatus 1000 and components disposed around the belt cleaning unit 100. In FIG. 3, the belt cleaning unit 100 has the cleaning brush roller 102 that serves as a cleaning member for removing residual toner from the surface of the intermediate transfer belt 8. In addition, the belt cleaning unit 100 includes a toner collection roller 103 that serves as a toner collection member for collecting toner attached to the cleaning brush roller 102, a scraping blade 104 that serves as a scraping member coming into contact with the toner collection roller 103 and scraping toner from a surface of the toner collection roller 103, a toner conveying screw 105, and the like. The toner conveying screw 105 conveys toner scraped from the surface of the toner collection roller 103 toward one end portion of a casing of the image forming apparatus 1000 to discharge the toner to the outside of the casing of the image forming apparatus 1000. The discharged toner drops into a disposed toner tank, not illustrated, arranged in the main body of the image forming apparatus 1000.

The cleaning brush roller 102 includes a rotatably supported metal rotating shaft member 102A and a brush roller portion 102B constituted by a plurality of bristles (conductive fibers) arranged vertically on the periphery of the rotating shaft member 102A.

The scraping blade 104 has not only the function of the scraping member for scraping toner from the surface of the toner collection roller 103 but also the function of charge supply unit for giving charge to the surface of the toner collection roller 103. Further, as described above, the cleaning brush roller 102 has the rotatably supported metal rotating shaft member 102A and the brush roller portion 102B made of the plurality of bristles (conductive fibers) arranged vertically on the periphery of the rotating shaft member. A cleaning bias having a polarity opposite the polarity of toner is applied by a brush power supply 110 to the cleaning brush roller 102. Further, a toner collection bias having a larger value than the cleaning bias and having a polarity opposite to the polarity of the toner is applied by a toner collection power source 110B to the toner collection roller 103.

A polarity control blade 101 is held in contact with the outer surface of the intermediate transfer belt 8 on the upstream side in the belt moving direction with respect to the cleaning nip in which the outer surface of the intermediate transfer belt 8 and the cleaning brush roller 102 are held in contact with each other. The polarity control blade 101 serves as a polarity control member for controlling a charging polarity of residual toner on the intermediate transfer belt 8 having passed the secondary transfer nip. A polarity control bias having the same polarity as the polarity of a regular charging polarity of toner is applied to the polarity control blade 101 by a power supply 110A.

A lubricant may be applied to the surface of the intermediate transfer belt 8 in order to protect the surface which is always scrubbed by the polarity control blade 101. In this case, solid lubricant such as a zinc stearate block is brought into contact with the brush roller portion 102B of the cleaning brush roller 102, and lubricant powder obtained by scraping the solid lubricant by rotation is applied to the surface of the intermediate transfer belt 8. In addition, a smoothing blade, not illustrated, may be arranged to smooth the lubricant powder applied to the surface of the intermediate transfer belt 8 to make the lubricant powder to be uniformly applied.

The belt cleaning unit 100 of the image forming apparatus 100 removes the residual toner on the intermediate transfer belt 8 according to the following four steps:

1. The polarity control blade 101 changes the polarity of toner on the intermediate transfer belt 8 so that all the toner has the same regular charging polarity (in this example, negative polarity);

2. The cleaning bias having the polarity opposite to the toner (in this example, positive polarity) is applied to the cleaning brush roller 102, whereby the residual toner remaining on the intermediate transfer belt 8 is removed onto the cleaning brush roller 102 in an electrostatic manner;

3. The toner collection bias having a larger absolute value than the cleaning bias and having the same polarity as the cleaning bias is applied to the toner collection roller 103, whereby the toner on the cleaning brush roller 102 is removed onto the toner collection roller 103; and 4. The scraping blade 104 scrapes off the toner on the toner collection roller 103.

These steps will be hereinafter explained in detail.

First, the amount of charge of the residual toner remaining on the intermediate transfer belt 8 having passed through the secondary transfer nip and the amount of charge of the toner having passed the contact position with the polarity control blade 101 (hereinafter referred to as "toner having passed the polarity control blade 101") will be explained. All the toner particles on the surface of the photoconductors 1 (which are the photoconductors 1Y, 1M, 1C, and 1K) are charged to a negative polarity, i.e., the regular polarity. By contrast, the residual toner remaining on the surface of the intermediate transfer belt 8 includes many oppositely-charged toner particles charged to a polarity opposite to the regular polarity. This is because there may occur an injection of charges having the opposite polarity to residual toner particles in the primary transfer nip and the secondary transfer nip.

To easily understand this fact, the drum cleaning devices 4Y, 4M, 4C, and 4K in FIG. 2 will be explained as an example instead of the belt cleaning unit 100.

Figure 4A:
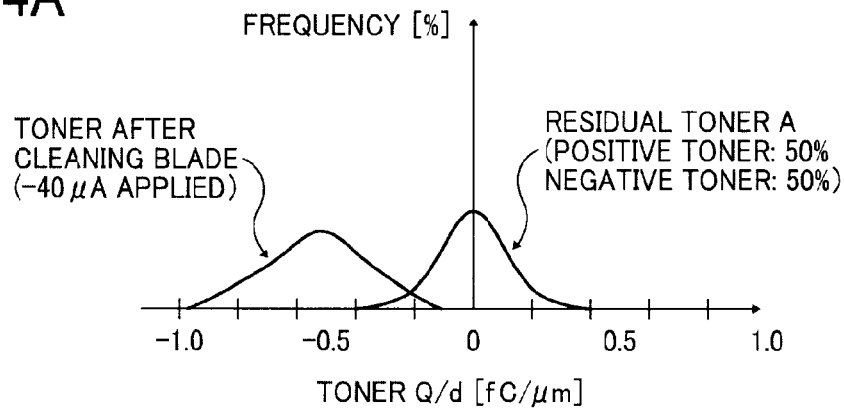
FIG. 4A is a graph showing a first example indicating a relation between a distribution of charge amount of residual toner remaining on a surface of an image carrier after passing a primary nip and a distribution of charge amount of residual toner remaining on the surface of the image carrier after a contact position with respect to a polarity control blade.
Figure 4B:
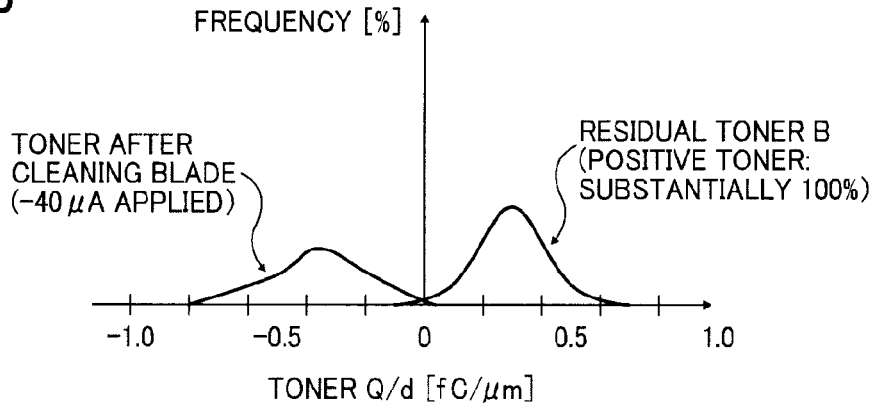
FIG. 4B is a graph showing a second example indicating a relation between a distribution of charge amount of residual toner remaining on a surface of an image carrier after passing a primary nip and a distribution of charge amount of residual toner remaining on the surface of the image carrier after a contact position with respect to a polarity control blade.
Figure 4C:
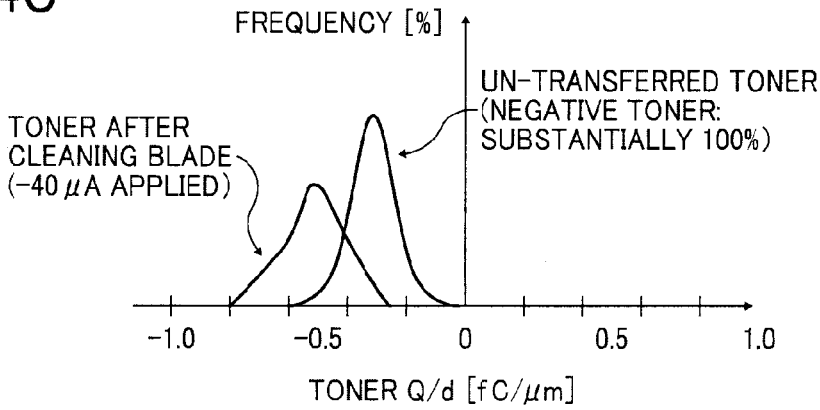
FIG. 4C is a graph showing a third example indicating a relation between a distribution of charge amount of residual toner remaining on a surface of an image carrier after passing a primary nip and a distribution of charge amount of residual toner remaining on the surface of the image carrier after a contact position with respect to a polarity control blade.

FIGS. 4A, 4B, and 4C are graphs illustrating the first, second, and third examples, each showing a relationship between a charge amount distribution of residual toner remaining on the surface of the photoconductor 1 having passed through the primary transfer nip and a charge amount distribution of residual toner having passed through a contact position with a polarity control blade.

It should be noted that the polarity control blade referred to herein is different from the polarity control blade 101 of the belt cleaning unit 100 as shown in FIG. 3. The polarity control blades are respectively arranged in the drum cleaning devices 4 (which are cleaning devices 4Y, 4M, 4C, and 4K in FIG. 2) of respective colors so as to be in contact with the surfaces of the photoconductors 1 having passed through the primary transfer nips. Similar to the polarity control blades 101 illustrated in FIG. 3, the polarity control blades receive polarity control biases having the same polarity as the regular charging polarity of the toner.

The toner charge amount distribution was measured as follows. That is, based on measured data of an electrical charge quantity "Q" of each toner and a particle diameter "d" of each toner that are measured with E-Spart Analyzer (EST-3) made by Hosokawa Micron Corporation, the Q/d (in unit of "fc/μm") distribution during sampling of several hundred residual toners remaining on the photoconductor 1 during image formation on the image forming apparatus 1000 is adopted as the charge amount distribution.

The first example shown in FIG. 4A has a broad distribution (hereinafter referred to as "residual toner A") including about half of positive polarity toner and about half of negative polarity toner in a mixed manner. The second example shown in FIG. 4B has a broad distribution (hereinafter referred to as "residual toner B") including much positive polarity toner than negative polarity toner in a mixed manner. The third example shown in FIG. 4C includes un-transferred toner during process control and the like and has a sharp distribution in which most of the toner is negative polarity toner.

When the residual toner A and the residual toner B remaining on the surface of the photoconductor 1 having passed through the primary transfer nip reach the position of the polarity control blade according to the rotation of the photoconductor 1, most of the residual toner is mechanically scraped off by the polarity control blade. However, when a so-called stick-slip occurs, a part of the residual toner passes through the polarity control blade. At this occasion, the residual toner is charged to the regular charging polarity, which is the negative polarity. As shown in FIGS. 4A and 4B, the charge amount distribution having passed through the contact position with the polarity control blade varies according to the charge amount distribution of toner that has not yet passed through the contact position, but after the toner passes through the polarity control blade, most of toner particles are charged to the negative polarity in both of the cases. The un-transferred toner as shown in FIG. 4C hardly changes, or is charged to a slightly negative polarity.

The polarity control blade arranged in the process unit 6 of each color is made of an elastic body such as polyurethane, and exhibits conductive property in a case where the material of the polarity control blade is mixed with a conductive agent such as carbon black and ion conductive agent. The electrical resistance thereof is preferably $2\times10^6$ Ω·cm to $5\times10^7$ Ω·cm. The thickness is preferably within a range of 1 mm to 3 mm. If the thickness is too thin, it is difficult to ensure the amount of pressure onto the photoconductor 1 because of winding of the surface of the photoconductor 1, winding of the polarity control blade itself, and the like. The hardness is to be within a range of 40 to 85 on JIS-A hardness meter. The polarity control blade need not be completely cleaned of the entire amount of residual toner remaining on the photoconductor 1, and some toner passing therethrough would not cause any problem.

The conditions of the polarity control blade (in the process unit 6) used in the experiment by the inventors of the present patent application are as follows:

Electrical resistance: $1\times10^6$ Ω·cm, or $1\times10^8$ Ω·cm;

Thickness: 2.4 mm or 2.8 mm;

Free length: 7 mm or 9 mm;

Hardness: 60 to 80 in JIS-A hardness; and

Blade impact resilience coefficient: 45%.

Figure 5:
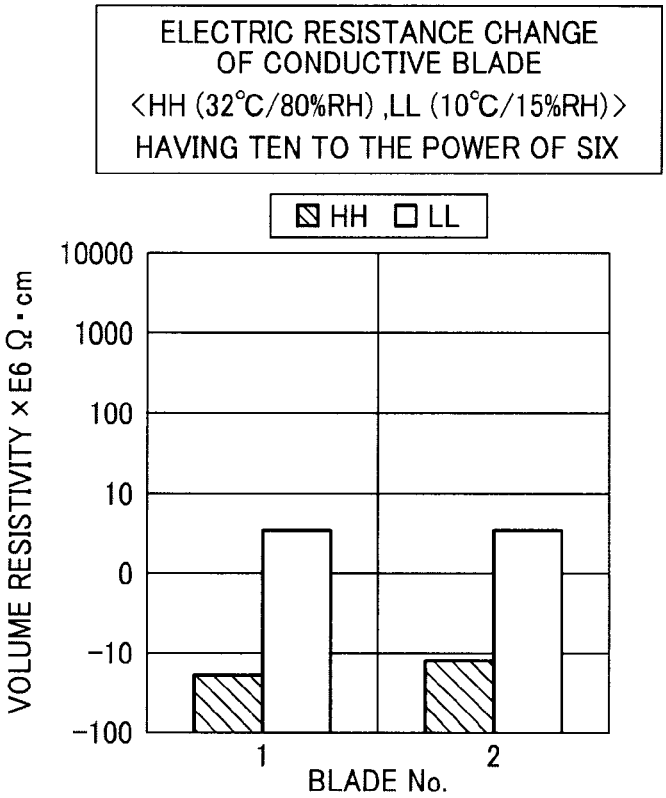
FIG. 5 is a graph showing a relation between environmental factors and an electrical resistance of polarity control blades No. 1 and No. 2.
Figure 6:
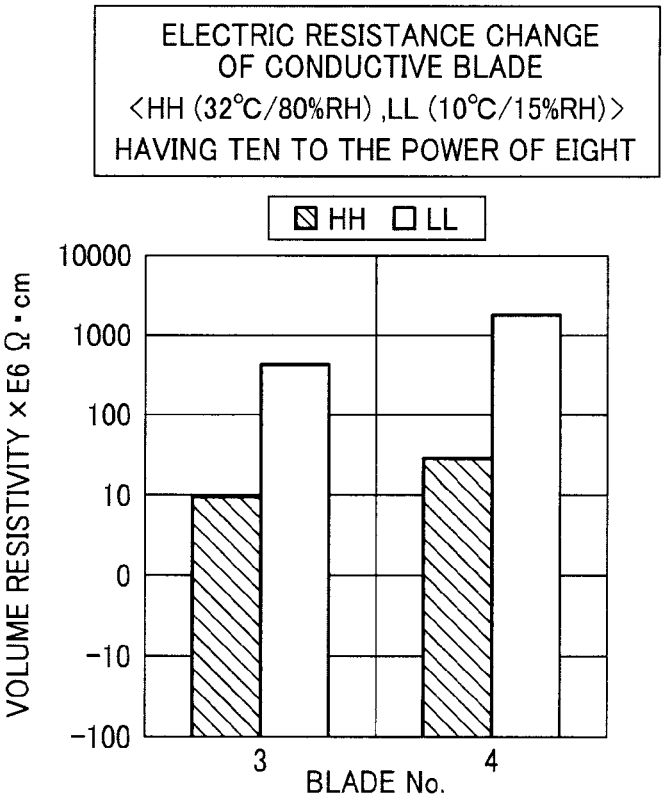
FIG. 6 is a graph showing a relation between environmental factors and electrical resistance of polarity control blades No. 3 and No. 4.

The electrical resistance of the polarity control blade including the above conditions varies according to an environment. For reference, the following Table 1 shows examples of installation conditions No. 1 to No. 4 of four kinds of polarity control blades. FIGS. 5 and 6 show relationships between environments of these polarity control blades and the electrical resistances.

TABLE 1

| Blade No. | 1 | 2 | 3 | 4 |
|---|---|---|---|---|
| Electrical Resistance | about $10^8$ | about $10^8$ | about $10^6$ | about $10^6$ |
| Blade Thickness [mm] | 2.8 | 2.4 | 2.8 | 2.4 |
| Contact Depth [mm] | 0.5 | 0.5 | 0.5 | 0.5 |
| Blade Free Length [mm] | 9 | 7 | 7 | 9 |
| Blade Impact Resilience Coefficient | 45 | 45 | 45 | 45 |

Figure 7:
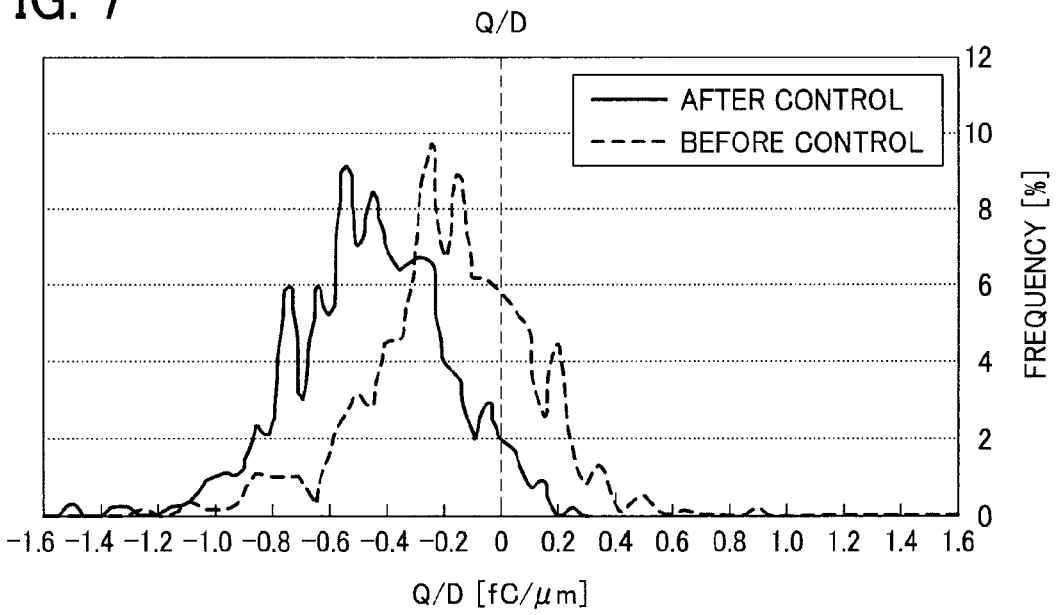
FIG. 7 is a graph showing changes in distribution of charge amount of residual toner before and after passing a contact position with respect to the polarity control blade.

When toner is sandwiched between the polarity control blade and the photoconductor 1, an electric current flows into the toner due to the polarity control bias applied to the polarity control blade. Then, the toner is charged to the same polarity as the applied voltage, and passes through the contact position with the polarity control blade. Further, the toner is also charged to the same polarity as the applied voltage by charge injection or discharge at narrow gaps between the photoconductor 1 and the polarity control blade at an entrance and an exit of the contact portion formed by the photoconductor 1 and the polarity control blade. As a result, the toner has the charge amount distribution of the negative polarity as shown in "after the toner passes the blade" in FIGS. 4A and 4B. FIG. 7 is a graph illustrating a variation of an electrical charge quantity distribution of residual toner before and after the toner passes through the contact position with the polarity control blade.

Figure 8:
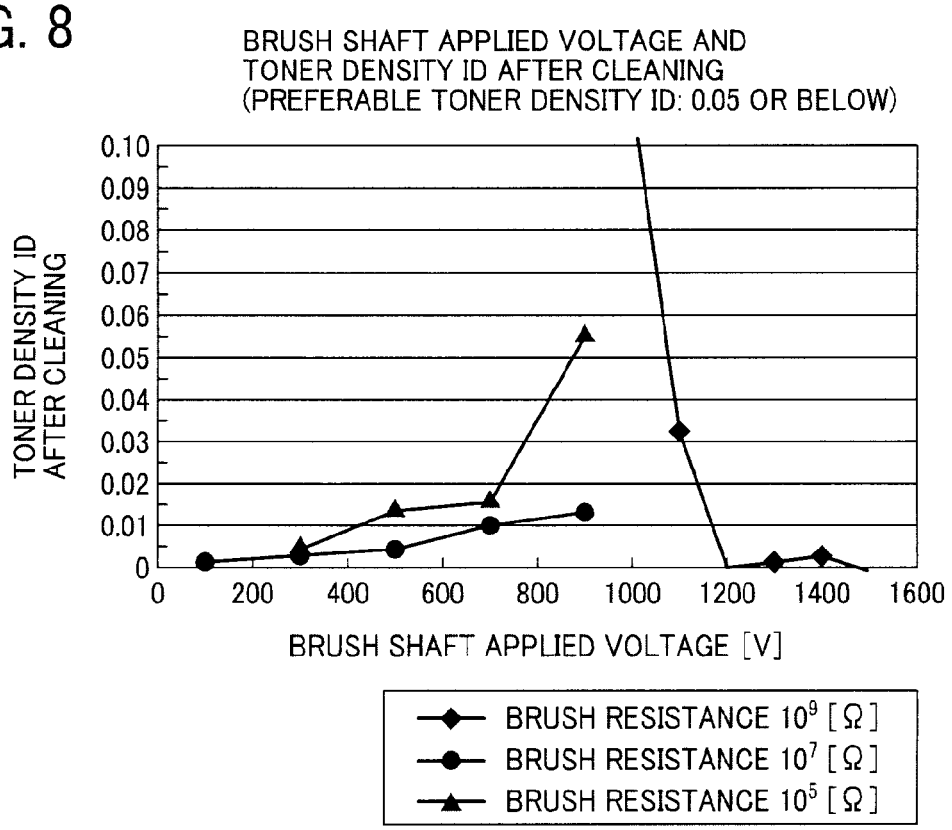
FIG. 8 is a graph showing cleaning abilities of cleaning brush rollers having electrical resistance of $1\times10^5$ Ω·cm, $1\times10^7$ Ω·cm, and $1\times10^9$ Ω·cm.

At the drum cleaning devices 4Y, 4M, 4C, and 4K, the toners having passed through the polarity control blades are removed from the drum surfaces by the cleaning brush rollers that rotate while being held in contact with the photoconductors 1. FIG. 8 shows drum cleaning performances of cleaning brush rollers that have electrical resistances of $1\times10^5$ Ω·cm, $1\times10^7$ Ω·cm, and $1\times10^9$ Ω·cm. When the electrical resistance is $1\times10^9$ Ω·cm, the applied voltage is high, and accordingly, the cost of the power source increases. By contrast, when the electrical resistance is $1\times10^5$ Ω·cm, an electric current is likely to flow in the photoconductor 1. Accordingly, the toner is charged to a positive polarity at a voltage lower than the voltage of $1\times10^7$ Ω·cm, and the toner reattaches to the photoconductor 1. Therefore, a margin of cleaning performance is small. Accordingly, the condition of $1\times10^7$ Ω·cm is most preferable.

It should be noted that the brush resistance is calculated by bringing the cleaning brush roller into contact with a SUS roller having a diameter of 10 mm to engage the cleaning brush roller with the SUS roller by 1 mm, rotating both of the cleaning brush roller and the SUS roller at 200 mm/sec, applying a voltage to a brush core shaft, and measuring an electric current. The fiber is usually made of an insulating material such as nylon, polyester, and acrylic resin, and the same effects can be obtained no matter any of the above materials is used. Typical fibers having core-in-sheath structures are disclosed in Japanese Patent Laid-Open No. H10-310974, Japanese Patent Laid-Open No. H10-131035, Japanese Patent Laid-Open No. H01-292116, Japanese Examined Patent Publication No. H07-033637, Japanese Examined Patent Publication No. H07-033606, and Japanese Examined Patent Publication No. H03-064604.

Figure 9:
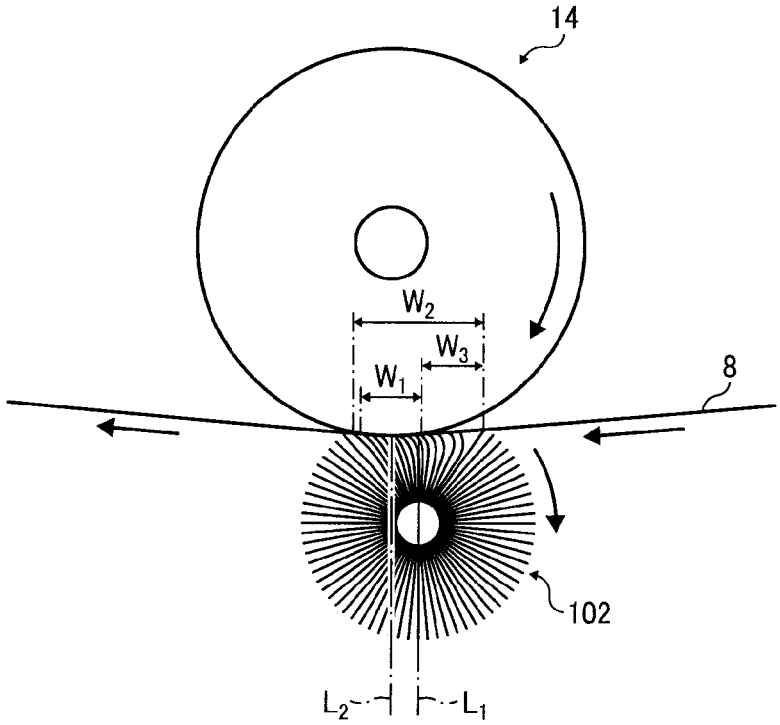
FIG. 9 is an enlarged view illustrating an example of a cleaning nip of a cleaning unit according to Exemplary Embodiment 1 of the present invention.

In the above-described example, the drum cleaning devices 4Y, 4M, 4C, and 4K have been used. However, the same phenomenon as that of the drum cleaning devices 4Y, 4M, 4C, and 4K occurs in the belt cleaning unit 100 as illustrated in FIG. 9. That is, in the belt cleaning unit 100, the polarity control blade 101 can remove the residual toner from the surface of the intermediate transfer belt 8 and can change the polarity of the residual toner having passed through the polarity control blade 101 so that all the toner has the regular charging polarity.

As described above, since the center of the cleaning nip is disposed upstream from the center of the belt wound area with respect to the opposing roller 14 in the belt moving direction, compared to a conventional cleaning device in which the center of the cleaning nip is disposed at the same position as the center of the belt wound area, the upstream tensioned nip area can be increased.

As illustrated in FIG. 9, the cleaning brush roller 102 serves as a rotary cleaning member, and a nip center line $L_1$ that corresponds to the center line of the cleaning nip in the belt moving direction is located upstream from a belt wound area center line $L_2$ that corresponds to the center line of the belt wound area with respect to the opposing roller 14. By so doing, as obvious from comparison with the conventional cleaning device, the upstream tensioned nip area that is indicated by the upstream nip width $W_3$ can be increased significantly. With this configuration, an area to preferably transfer residual toner remaining on the intermediate transfer belt 8 onto the cleaning brush roller 102 can be more increased than the conventional cleaning device at the upstream side from the center of the belt wound area with respect to the opposing roller 14 that can cause residual toner to be oppositely charged easily. Therefore, the surface of the intermediate transfer belt 8 can be cleaned better than that provided in the conventional cleaning device.

Instead of using the polarity control blade 101, corona discharge may be used to change the polarity of the residual toner such that all the toner has the normal polarity. In this case, an electric current of about −800 μA may be provided to the corona discharge.

Subsequently, a description is given of detailed configuration of the image forming apparatus 1000.

Figure 10:
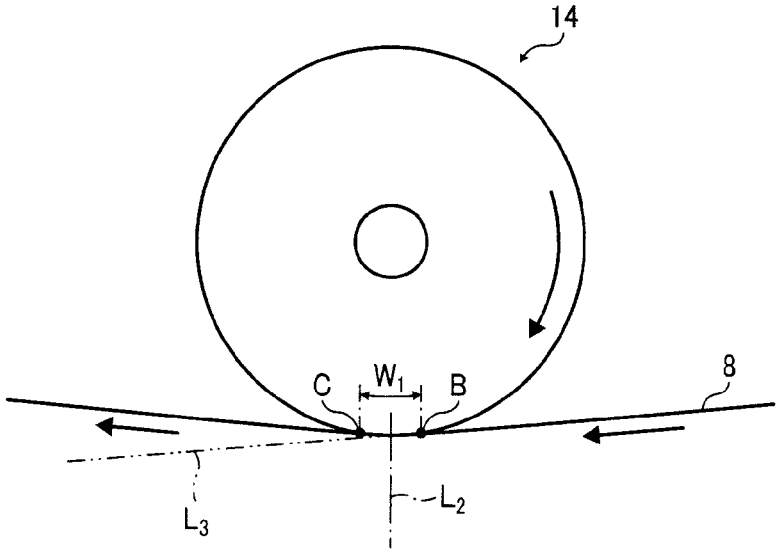
FIG. 10 is an enlarged view of a roller and an intermediate transfer belt in the image forming apparatus according to Exemplary Embodiment 1 of the present invention.

FIG. 10 is an enlarged configuration diagram illustrating the opposing roller 14 and the intermediate transfer belt 8 in the image forming apparatus 1000. In FIG. 10, the opposing roller 14 is made of an aluminum roller having a diameter of 22 mm, and the opposing roller 14 is driven to rotate in a clockwise direction in FIG. 10 according to an endless movement of the intermediate transfer belt 8. The intermediate transfer belt 8 is extendedly looped around an arc-shaped area, between a point B and a point C, of the entire periphery of the opposing roller 14 in FIG. 10. A length of the belt wound area in the belt moving direction, i.e., a belt wound width, is denoted by a symbol $W_1$ in FIG. 10. In FIG. 10, a chain double-dashed line denoted by a symbol "$L_2$" represents a belt wound area center line, i.e., the length of the belt contact area (arc BC) in the belt moving direction. On the other hand, a chain double-dashed line denoted by a symbol "$L_3$" represents a belt extending straight line that is made by extending the belt moving direction of the intermediate transfer belt 8 immediately before the intermediate transfer belt 8 enters into the point B.

Figure 11:
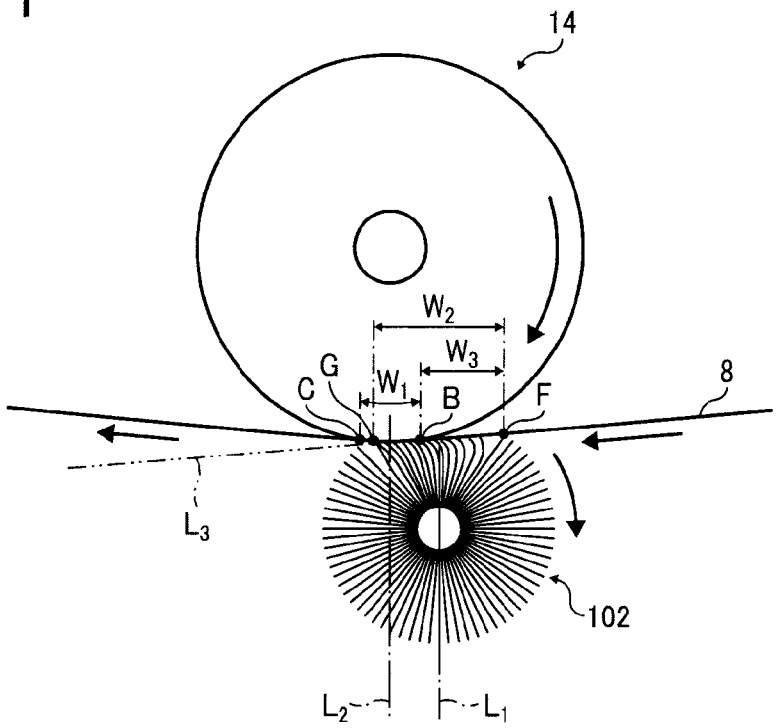
FIG. 11 is an enlarged view of a roller, an intermediate transfer belt, and a cleaning brush roller in the image forming apparatus according to Exemplary Embodiment 1 of the present invention.

FIG. 11 is an enlarged configuration diagram illustrating the opposing roller 14, the intermediate transfer belt 8, and the cleaning brush roller 102 in the image forming apparatus 1000. In FIG. 11, the cleaning brush roller 102 comes into contact with the outer surface of the intermediate transfer belt 8 in an area between a nip entrance point F and a nip exit point G (an area denoted by an entire nip width $W_2$) to form a cleaning nip. The cleaning brush roller 102 rotates in a counter direction (a clockwise direction in FIG. 11) so that the surface of the cleaning brush roller 102 moves in the cleaning nip in a direction opposite to the direction of the intermediate transfer belt 8.

In FIG. 11, a chain double-dashed line denoted with a symbol "$L_1$" is a nip center line located in the center of the belt moving direction in the cleaning nip. As shown in FIG. 11, in the image forming apparatus 1000, the nip center line $L_1$ is located at an upstream side in the belt moving direction with respect to the belt wound area center line $L_2$, and an end portion at an upstream side in the belt moving direction of the cleaning nip between the nip entrance point F and the nip exit point G is adopted as an upstream tensioned nip area in which the brush comes into contact with the tensioned belt area. In this structure, the upstream tensioned nip area (an area between the nip entrance point F and the tension entrance point B) denoted by the upstream nip width $W_3$ is larger than that of a conventional image forming apparatus in which the nip center line $L_1$ and the belt wound area center line $L_2$ are positioned in the same location. Accordingly, at an upstream side with respect to the center portion of the belt wound area in which toner is likely to be charged to an opposite polarity, the area in which the residual toner remaining on the intermediate transfer belt 8 can be suitably moved to the cleaning brush roller 102 is made larger than that of the conventional image forming apparatus. Therefore, the intermediate transfer belt 8 can be cleaned better than the conventional example.

Figure 12:
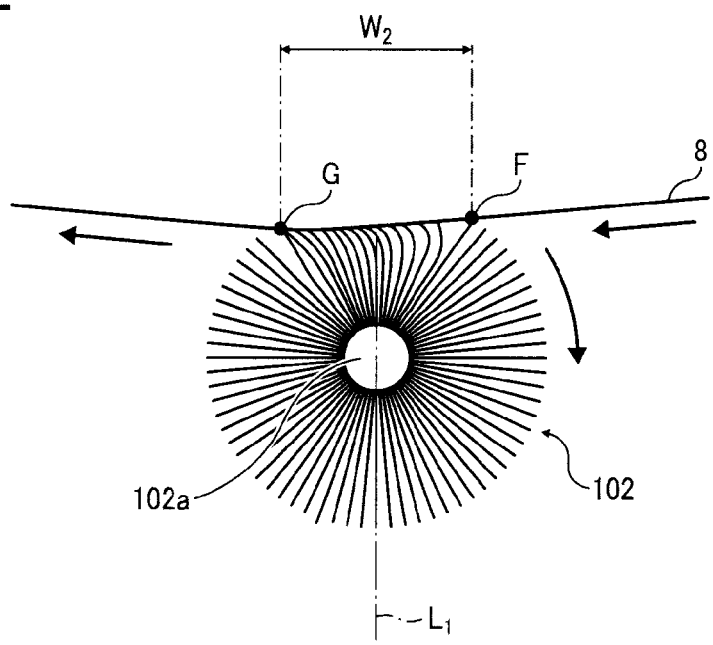
FIG. 12 is an enlarged view of an intermediate transfer belt and a cleaning brush roller in the image forming apparatus according to Exemplary Embodiment 1 of the present invention.

FIG. 12 is an enlarged configuration diagram illustrating the intermediate transfer belt 8 and the cleaning brush roller 102 in the image forming apparatus 1000. In FIG. 12, the position at which the intermediate transfer belt 8 comes closest to the rotating shaft member 102 of the cleaning brush roller 102 is the position of the nip center line $L_1$. Therefore, at the position of this nip center line $L_1$, a nip pressure becomes the highest, and a scraping force for scraping toner from the intermediate transfer belt 8 becomes the highest. At the position of this nip center line $L_1$, the residual toner remaining on the intermediate transfer belt 8 can be physically moved to the intermediate transfer brush most easily. In the image forming apparatus 10000, as described above, the nip center line $L_1$ at which the toner can be physically moved to the cleaning brush roller 102 most easily is located at the upstream side in the belt moving direction with respect to the belt wound area (arc BC) as shown in FIG. 11. In other words, the nip center line $L_1$ is positioned at the location of the upstream tensioned nip area at which there is no wrapping to the opposing roller 14. In the upstream tensioned nip area, the amount of cleaning electric current is greatly less than that in the belt wound area. Since the nip center line $L_1$ is positioned at the location of the above-described upstream tensioned nip area at which the toner can be physically moved to the cleaning brush roller 102 most easily, most of the residual toner remaining on the intermediate transfer belt 8 can be moved into the brush portion 102B of the cleaning brush roller 102 before the toner is charged to the opposite polarity by the cleaning electric current.

As shown in FIG. 11, at a downstream side in the belt moving direction of the cleaning nip between the nip entrance point F and the nip exit point G, the nip exit point G is located at an upstream side with respect to the exit point C of the belt wound area (arc BC). This is because the cleaning brush roller 102 provided to the image forming apparatus 1000 is configured to rotate in the counter direction with respect to the intermediate transfer belt 8. In this structure, a position at which a brush end begins to come into contact with the intermediate transfer belt 8 according to the rotation of the cleaning brush roller 102 is the nip exit point G. This nip exit point G exerts a large mechanical stress on the intermediate transfer belt 8 when the plurality of bristles constituting the brush portion 102B of the cleaning brush roller 102 are abutted against the intermediate transfer belt 8. If, at the nip exit point G, the intermediate transfer belt 8 is not looped around the opposing roller 14, and the tensioned belt area freely becoming rippled is positioned at the nip exit point G, the intermediate transfer belt 8 becomes greatly rippled due to the above-described large mechanical stress. Therefore, in the image forming apparatus 1000, the nip exit point G is located at a tensioned belt area at an upstream side of the exit point C of the tensioned belt area. Since the tensioned belt area does not become freely rippled, it is possible to prevent an occurrence of ripple and consequent vibration of the intermediate transfer belt 8 caused by the brush bumping into the tensioned belt area at the nip exit point G.

Figure 13:
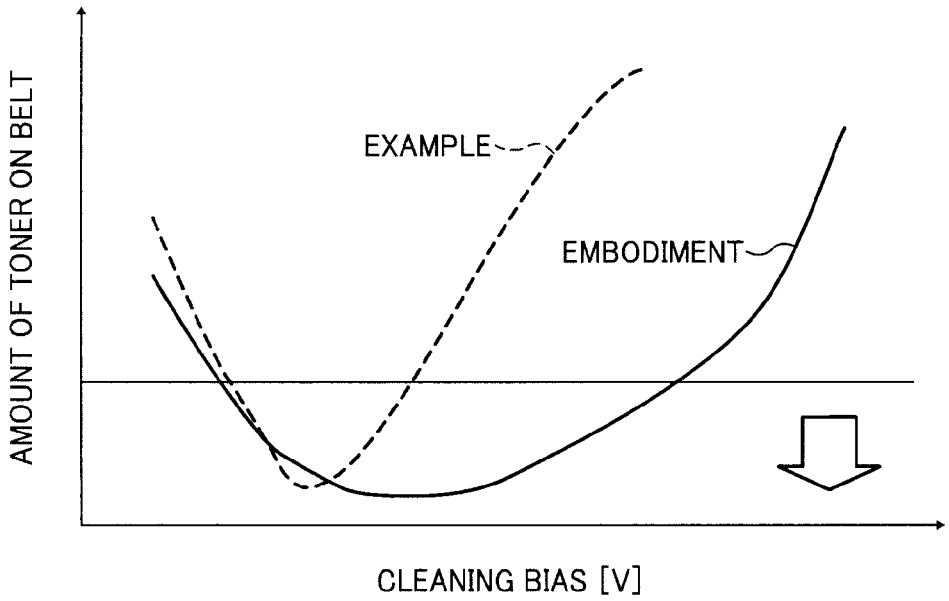
FIG. 13 is a graph showing a difference in toner cleaning ability of each intermediate transfer belt in a conventional image forming apparatus and an image forming apparatus according to Exemplary Embodiment 1 of the present invention.

FIG. 13 is a graph illustrating a difference between cleaning performance of toner on the intermediate transfer belt 8 of the image forming apparatus 1000 according to Exemplary Embodiment 1 of the present invention and a conventional example in which the nip center line $L_1$ and the belt wound area center line $L_2$ are positioned at the same location. When the conventional example and the image forming apparatus 1000 are compared, it is understood that, in the image forming apparatus 1000 according to Exemplary Embodiment 1 of the present invention, an appropriate value range in which high cleaning performance of the cleaning bias can be achieved is greatly larger than that of the conventional example.

In a normal environment (an environment other than high temperature/high humidity environment), an example of specific configuration conditions of the belt cleaning unit 100 of the image forming apparatus 1000 is as follows.

<Conditions of Cleaning Brush Roller 102>

Brush material: conductive polyester (including a conductive carbon in fibers, and the surfaces of the fibers are made of polyester. A so-called core-in-sheath structure).

Brush resistance: $1\times10^5\Omega$ (axial line direction entire area measurement under a voltage application condition of 1000 V).

Brush shaft application voltage (cleaning bias): +800V.

Brush bristle density: 100,000 bristles/inch$^2$, fiber diameter about 25 μm to 35 μm, with bristle flattening processing at brush end.

Brush diameter: 16 mm.

Brush contact depth with the intermediate transfer belt 8: 1 mm.

Rotating direction: counter direction with respect to the intermediate transfer belt 8.

When a bristle slanting processing for slanting bristles of the brush portion 102B of the cleaning brush roller 102 in one direction is performed after the bristles thereof are formed into a brush roll shape, it is difficult for the cleaning brush roller 102 to bring a conducting agent exposed on cross sections of fibers to be held in contact with the intermediate transfer belt 8. Accordingly, the charge injection property into the toner is reduced, and a margin of cleaning performance is enhanced. The fiber is usually made of an insulating material such as nylon, polyester, and acrylic resin, and the same effects can be obtained no matter any of the above materials is used. Typical fibers having core-in-sheath structures are disclosed in Japanese Patent Laid-Open No. H10-310974, Japanese Patent Laid-Open No. H10-131035, Japanese Patent Laid-Open No. H01-292116, Japanese Examined Patent Publication No. H07-033637, Japanese Examined Patent Publication No. H07-033606, and Japanese Examined Patent Publication No. H03-064604.

<Conditions of Toner Collection Roller 103>

Toner collection roller core shaft material: SUS (stainless).

Toner collection roller surface material: acryl UV curable resin layer (thickness of 3 μm to 5 μm) formed on surface layer made of PVDF (thickness of 100 μm).

Roller diameter: 14 mm

Brush fiber contact depth with toner collection roller: 1.5 mm.

Toner collection roller core shaft application voltage (toner collection bias): +1400 V.

Rotating direction: counter direction with respect to the cleaning brush roller 102.

Figure 14:
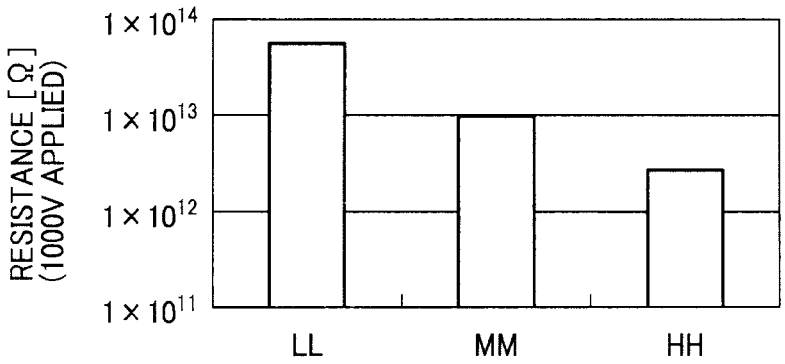
FIG. 14 is a graph showing a relation between environment and electrical resistance of a collection roller in the image forming apparatus according to Exemplary Embodiment 1 of the present invention.

The toner collection roller 103 was configured to have a PVDF having a thickness of 100 μm on the surface of the core shaft made of stainless, and further have an acryl UV curable resin layer on the surface thereof (high-resistance roller). The electrical resistances of the toner collection roller 103 are under a low temperature/low humidity environment (LL), a medium temperature/medium humidity environment (MM), and a high temperature/high humidity environment (HH) as shown in FIG. 14. The same performance can be achieved not only by the toner collection roller 103 used in Exemplary Embodiment 1 of the present invention but also by a toner collection roller having a conductive core shaft covered by a high-resistance elastic tube of about several μm to 100 μm and a toner collection roller that is further an insulating coating roller. Examples of materials for the surface of the toner collection roller 103 include a PVDF tube, a PFA tube, a PI tube, an acryl coating, a silicone coating (for example, coating with PC (polycarbonate) including silicone particles), ceramics, and fluorine coating.

As described above, the bristles of the cleaning brush roller 102 have the core-in-sheath structure including a conductive material in fibers and insulating polyester on the external surfaces of the fibers. However, as an alternative example, it may be possible to employ bristles in which the conductive property and the insulating property are arranged oppositely. In other words, an outside conductive structure may be employed, in which the insides of the fibers are made of an insulating material such as polyester, and the surfaces of the fibers are made of a conductive material. The result of the experiment conducted by the inventors of the present patent application shows that it is more preferable to use the outside conductive structure than the structure using bristles of the core-in-sheath structure in terms of stabilizing a cleaning electric current flowing in the cleaning nip.

However, when a conventional structure is used, the outside conductive structure has more significantly caused the following phenomenon than the core-in-sheath structure, which are that the toner is charged to the opposite polarity in the cleaning nip by the cleaning electric current and that the toner is discharged from the brush portion 102B of the cleaning brush roller 102 to the surface of the intermediate transfer belt 8. As described above, such phenomenon can be efficiently suppressed when the structure shown in FIG. 11 is employed. In other words, the drawback of the outside conductive structure can be overcome when the following structure is employed, which are that the nip center line $L_1$ is positioned at the upstream side in the belt moving direction with respect to the belt wound area center line $L_2$, and the end portion at the upstream side in the belt moving direction of the cleaning nip between the nip entrance point F and the nip exit point G is adopted as the upstream tensioned nip area in which the brush portion 102B of the cleaning brush 102 comes into contact with the tensioned belt area. Not only the drawback is overcome but also an advantage of the outside conductive structure for stabilizing the cleaning electric current can be obtained.

As described above, the toner collection roller 103 in the image forming apparatus 1000 has a high resistance layer coated on the surface. However, as an alternative example, the toner collection roller 103 may have a low resistance layer coated on the surface thereof, or a solid metal roller may be used as the toner collection roller 103. In a case where collection efficiently is regarded as important, it is advantageous to use a solid metal roller.

<Conditions of Scraping Blade 104>

Material: SUS.

Thickness: 100 μm.

Blade contact angle: 20 degrees.

Blade contact depth with toner collection roller 103: 0.6 mm.

Application voltage (scraping bias) to scraping blade: +2000 V.

The toner collection bias is applied to the core shaft of the toner collection roller 103, and when the surface potential thereof is measured, the surface potential is about the same as the electric potential of the toner collection bias. However, when much toner is input during the cleaning operation, the surface potential of the toner collection roller 103 decreases according to the input of toner. Accordingly, it becomes impossible to ensure a necessary electric potential difference (toner collection potential difference) between the toner collection roller 103 and the cleaning brush roller 102, and the performance for collecting the toner from the cleaning brush roller 102 is reduced. Therefore, for example, when one sheet of A4 size is printed, a necessary magnitude of collection potential difference can be ensured. In contrast, when a successive printing operation is performed, and there is a large amount of toner input to the brush, there may be a case where it is impossible to ensure the collection potential difference. In such case, the toner accumulates in the cleaning brush roller 102, and there is a problem in that the toner is discharged from the cleaning brush roller 102 to the intermediate transfer belt 8. In order to solve this problem, a scraping voltage is applied to the conductive scraping blade 104, so that charge is given to the surface of the toner collection roller 103. Thus, the collection potential difference is increased to enhance the toner collecting performance.

It is not so necessary to apply the scraping voltage to the scraping blade 104, when the polarity control blade 101 has not yet greatly worn out, and not so much toner passes at the contact position with the polarity control blade 101. However, the application of a scraping bias is particularly effective, in a case where relatively much toner passes at the contact position with the polarity control blade 101 due to the degradation of the polarity control blade 101, or in a case where much toner passes in a low temperature/low humidity environment than in high temperature/high humidity environment.

The inventors of the present patent application have conducted an experiment to prove that the structure shown in FIG. 11 can provide a better cleaning performance than the structure of the conventional cleaning device. More specifically, a test printer having almost the same structure as the image forming apparatus 1000 according to Exemplary Embodiment 1 of the present invention was prepared. This test printer is different from the image forming apparatus 1000 according to Exemplary Embodiment 1 of the prevent invention with regard to the points listed below. The test printer is common to the image forming apparatus 1000 according to Exemplary Embodiment 1 of the prevent invention in that it has the structure as shown in FIG. 11.

<Cleaning Brush Roller 102 of Test Printer>

Brush material: conductive polyester, having outside conductive structure in which the insides of the fibers are insulating and the external surfaces of the fibers are conductive.

Brush resistance: $1\times10^7\Omega$ (axial line direction entire area measurement under a voltage application condition of 1600 V).

Brush shaft application voltage (cleaning bias): +1600V.

Brush bristle density: 70,000 bristles/inch$^2$, fiber diameter about 25 μm to 35 μm, with bristle flattening processing at brush end.

Fiber thickness: 6 [denier].

Brush diameter: 15 mm.

The brush contact depth with the intermediate transfer belt 8 and the brush rotation direction are the same as those of Exemplary Embodiment 1 of the present invention.

<Toner Collection Roller 103 of Test Printer>

Toner collection roller core shaft material: SUS (stainless).

Toner collection roller surface material: the same solid stainless as the main body of the image forming apparatus 1000.

Roller diameter: 15 mm.

Toner collection roller core shaft application voltage (toner collection bias): +2000 V.

<Scraping Blade 104 of Test Printer>

Application voltage to scraping blade (scraping bias): +2000 V (same as toner collection bias).

It should be noted that 0V may be employed as the scraping bias. In a case where the surface of the toner collection roller 103 is made of a solid metal as in the test printer, it is necessary to set the scraping bias to the same value as the toner collection bias or 0V (float). In a case where the surface of the toner collection roller 103 is made of a conductive non-metal material but the electrical resistance thereof is relatively low, it is preferable to set the scraping bias to the same value as the toner collection bias or 0V (float) as in the test printer, instead of setting the scraping bias to a value larger than the toner collection bias as in the image forming apparatus 1000 according to Exemplary Embodiment 1 of the present invention.

In the secondary transfer step in the experiment, the secondary transfer roller 15 being held in contact with the outer surface of the intermediate transfer belt 8 to form the secondary transfer nip was grounded. By contrast, the secondary transfer bias having a minus polarity, i.e., the same polarity as the charging polarity of the toner, was applied to the secondary transfer opposing roller 12 arranged inside of the loop of the intermediate transfer belt 8. The secondary transfer bias was controlled in such a manner that the output current value is subjected to constant current control so that the output current from the power source attains −63 [μA]. This is because the inventors have found in a previous experiment that, when the above-described conditions of the constant current control are set, a relatively large amount of secondary residual toner having a positive polarity is generated on the surface of the intermediate transfer belt 8 having passed through the secondary transfer nip. In other words, the experiment was conducted upon intentionally setting the conditions in which a relatively large amount of secondary residual toner is generated.

Each of the following six conditions is independently employed as the position of the cleaning brush roller 102:

(1) The center of the roller shaft of the cleaning brush roller 102 is set at a position upstream side by 5 mm in the belt moving direction with respect to the center of the shaft of the opposing roller 14;

(2) The center of the roller shaft of the cleaning brush roller 102 is set at a position upstream side by 3 mm in the belt moving direction with respect to the center of the shaft of the opposing roller 14;

(3) The center of the roller shaft of the cleaning brush roller 102 is set at a position upstream side by 2 mm in the belt moving direction with respect to the center of the shaft of the opposing roller 14;

(4) The center of the roller shaft of the cleaning brush roller 102 is set at a position upstream side by 1 mm in the belt moving direction with respect to the center of the shaft of the opposing roller 14;

(5) The center of the roller shaft of the cleaning brush roller 102 is set immediately below the center of the shaft of the opposing roller 14 (conventional structure); and (6) The center of the roller shaft of the cleaning brush roller 102 is set at a position downstream side by 3 mm in the belt moving direction with respect to the center of the shaft of the opposing roller 14 (structure opposite to the present invention).

Figure 15:
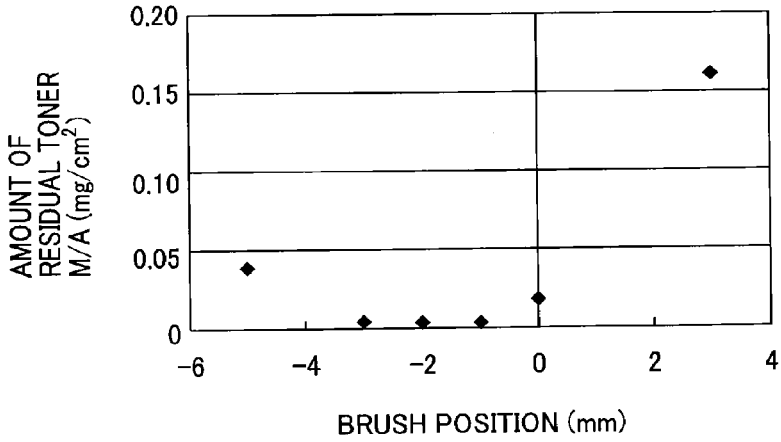
FIG. 15 is a graph showing a position of a cleaning brush roller and an amount of residual toner remaining on a surface of an image carrier of the image forming apparatus according to Exemplary Embodiment 1 of the present invention.

In each of these six types of conditions, a solid black image is output onto an A3 size sheet, and the amount of residual toner remaining on the intermediate transfer belt 8 having passed through the belt cleaning unit 100 is measured. A graph in FIG. 15 shows the results of this experiment. FIG. 15 shows that the condition of the negative polarity at the brush position indicates that the center of the shaft of the cleaning brush roller 102 is displaced to the upstream side in the belt moving direction with respect to the center of the shaft of the opposing roller 14. In other words, FIG. 15 shows that the above-described conditions (1), (2), (3), (4), (5), and (6) are the conditions for making the brush position at −5, −3, −2, −1, 0, +3, respectively. As shown in the figure, the structure in which the center of the shaft of the opposing roller 14 is appropriately displaced to the upstream side in the belt moving direction with respect to the center of the shaft of the opposing roller 14 can reduce an occurrence of residual toner, compared with the structure having no displacement ((5)) and the structure in which the opposing roller 14 is displaced to the downstream side in the belt moving direction.

Figure 16:
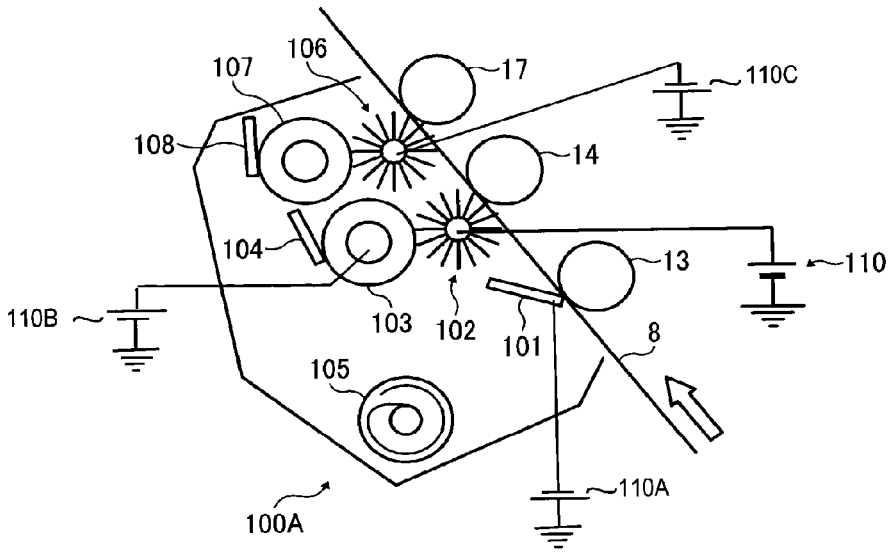
FIG. 16 is an enlarged view of a belt cleaning unit of an image forming apparatus according to a first modified embodiment and components disposed around the belt cleaning unit.

FIG. 16 is an enlarged configuration diagram showing a belt cleaning unit 100A of the image forming apparatus 1000 according to a first modification based on Exemplary Embodiment 1 and elements around the belt cleaning unit 100A. The first modification is different from Exemplary Embodiment 1 in that the belt cleaning unit 100A according to the first modification includes a second cleaning brush roller 106 for cleaning the intermediate transfer belt 8 at a downstream side in the belt moving direction with respect to the cleaning brush roller 102. The second cleaning brush roller 106 is arranged to interpose the intermediate transfer belt 8 with a second opposing roller 107 that is arranged inside of the loop of the intermediate transfer belt 8 and around which the intermediate transfer belt 8 is extended. More specifically, in the same manner as the cleaning brush roller 102, the second cleaning brush roller 106 is held in contact with the intermediate transfer belt 8 so that a center line in the belt moving direction of a cleaning nip is positioned in an upstream side in the belt moving direction with respect to a center line in the belt moving direction of a tensioned belt area on the second cleaning brush roller 106. Accordingly, residual toner can also be cleaned better at the second cleaning brush roller 106, compared with a conventional member.

The conditions at the polarity control blade 101, the cleaning brush roller 102, the toner collection roller 103, and the scraping blade 104 are respectively the same as those of Exemplary Embodiment 1.

Even the image forming apparatus 1000 according to Exemplary Embodiment 1 of the present invention cannot completely remove the toner from the belt surface having passed through the cleaning brush roller 102. It is inevitable to leave a very small amount of toner thereon. Most of the residual toner is oppositely charged to a polarity opposite to the regular polarity. Such oppositely charged toner is generated not because of the belt cleaning unit 100 but because of the toner particles themselves in many cases. The toner particles themselves are not normal or easily charged oppositely.

In the first modification, the second cleaning brush roller 106 is arranged for the purpose of cleaning such oppositely charged toner. A second cleaning bias applied to the second cleaning brush roller 106 by a power supply 110C has the same polarity as the regular charging polarity of the toner (in this example, negative polarity).

The oppositely charged toner having moved from the intermediate transfer belt 8 to the second cleaning brush roller 106 moves to the surface of the second toner collection roller 107 rotating while being in contact with the second cleaning brush roller 102. A second toner collection bias having a larger absolute value than the second cleaning bias and having the same polarity as the regular charging polarity of the toner is applied to this second toner collection roller 107.

The oppositely charged toner collected to the surface of the second toner collection roller 107 is scraped off from the roller surface by a second scraping blade 108 in contact with the second toner collection roller 107. A second scraping bias having an absolute value equal to or more than the second toner collection bias and having the same polarity as the regular charging polarity of the toner is applied to this second scraping blade 108.

An example of specific conditions of the second cleaning brush roller 106 and the like is as follows:

<Conditions of Second Cleaning Brush Roller 106>

Brush material: conductive polyester (including a conductive carbon in fibers, and the surfaces of the fibers are made of polyester. A so-called core-in-sheath structure);

Brush resistance: $1\times10^7\Omega$ (axial line direction entire area measurement under a voltage application condition of 1000V);

Brush shaft application voltage (second cleaning bias): −800V;

Brush bristle density: 100,000 bristles/inch$^2$, fiber diameter about 25 μm to 35 μm, with bristle flattening processing at brush end;

Brush diameter: 16 mm;

Brush contact depth with the intermediate transfer belt 8: 1 mm; and

Rotating direction: counter direction with respect to the belt.

<Conditions of Second Toner Collection Roller 107>

Toner collection roller core shaft material: SUS (stainless).

Toner collection roller surface material: acryl UV curable resin layer (thickness of 3 to 5 μm) formed on surface layer made of PVDF (thickness of 100 μm).

Roller diameter: 14 mm.

Brush fiber contact depth with second toner collection roller: 1.5 mm.

Toner collection roller core shaft application voltage (second toner collection bias): −1200V.

Rotating direction: counter direction with respect to the second cleaning brush roller 106.

<Conditions of Second Scraping Blade 108>

Material: SUS.

Thickness: 100 μm.

Blade contact angle: 20 degrees.

Blade contact depth with second toner collection roller 107: 0.6 mm.

Application voltage (second scraping bias) to second scraping blade: −1200V.

Figure 17:
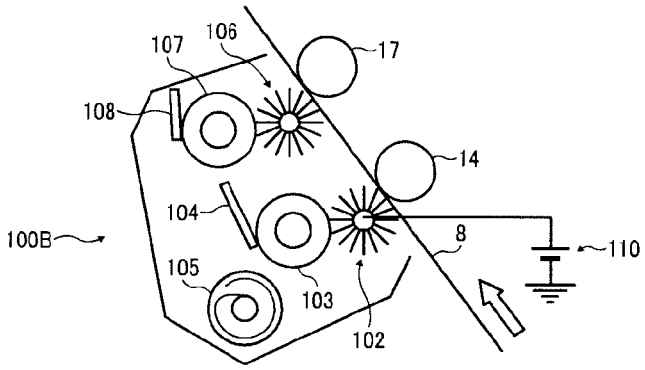
FIG. 17 is an enlarged view of a belt cleaning unit of an image forming apparatus according to a second modified embodiment and components disposed around the belt cleaning unit.

FIG. 17 is an enlarged configuration diagram showing a belt cleaning unit 100B according to a second modification of the image forming apparatus 1000 according to Exemplary Embodiment 1 of the present invention and units disposed around the belt cleaning unit 100B. The second modification is different from Exemplary Embodiment 1 of the present invention in that the belt cleaning unit 100B according to the second modification includes the second cleaning brush roller 106 but does not include any polarity control blade.

Since the belt cleaning unit 100B according to the second modification does not have the polarity control blade for changing the polarity of residual toner having not yet been cleaned by the cleaning brush roller 102 so that all the residual toner has the regular charging polarity, there is much toner remaining on the surface of the intermediate transfer belt 8 having passed through the cleaning nip formed by the cleaning brush roller 102. Most of the residual toner is made of oppositely charged toner particles. The residual toner is removed by the second cleaning brush roller 106 from the surface of the intermediate transfer belt 8. A second cleaning bias applied to the second cleaning brush roller 106 is a bias having the same polarity as the regular charging polarity of the toner.

Various kinds of members in the second modification are as follows:

<Conditions of Cleaning Brush Roller 102>

Brush material: conductive polyester (including a conductive carbon in fibers, and the surfaces of the fibers are made of polyester. A so-called core-in-sheath structure);

Brush resistance: $1\times10^7\Omega$ (axial line direction entire area measurement under a voltage application condition of 1000V);

Brush shaft application voltage (cleaning bias): +1000V;

Brush bristle density: 100,000 bristles/inch$^2$, fiber diameter about 25 μm to 35 μm, with bristle flattening processing at brush end;

Brush diameter: 16 mm;

Brush contact depth with the intermediate transfer belt 8: 1 mm;

Rotating direction: counter direction with respect to the intermediate transfer belt 8.

<Conditions of Toner Collection Roller 103>

Toner collection roller core shaft material: SUS (stainless).

Toner collection roller surface material: acryl UV curable resin layer (thickness of 3 μm to 5 μm) formed on surface layer made of PVDF (thickness of 100 μm).

Roller diameter: 14 mm.

Brush fiber contact depth with the toner collection roller 103: 1.5 mm.

Toner collection roller core shaft application voltage (toner collection bias): +1600V.

Rotating direction: counter direction with respect to the cleaning brush roller 102.

<Conditions of Scraping Blade 104>

Material: SUS.

Thickness: 100 μm.

Blade contact angle: 20 degrees.

Blade engaging amount with second toner collection roller 107: 0.6 mm.

Application voltage (second scraping bias) to second scraping blade: +1600V.

<Conditions of Second Cleaning Brush Roller 106>

Brush material: conductive polyester (including a conductive carbon in fibers, and the surfaces of the fibers are made of polyester. A so-called core-in-sheath structure).

Brush resistance: $1\times10^7\Omega$ (axial line direction entire area measurement under a voltage application condition of 1000 V).

Brush shaft application voltage (second cleaning bias): −800V.

Brush bristle density: 100,000 bristles/inch$^2$, fiber diameter about 25 μm to 35 μm, with bristle flattening processing at brush end.

Brush diameter: 16 mm.

Brush contact depth with the intermediate transfer belt 8: 1 mm.

Rotating direction: counter direction with respect to the intermediate transfer belt 8.

<Conditions of Second Toner Collection Roller 107>

Toner collection roller shaft material: SUS (stainless).

Toner collection roller surface material: acryl UV curable resin layer (thickness of 3 μm to 5 μm) formed on surface layer made of PVDF (thickness of 100 μm).

Roller diameter: 14 mm.

Brush fiber contact depth with second toner collection roller: 1.5 mm.

Toner collection roller core shaft application voltage (second toner collection bias): −1200V.

Rotating direction: counter direction with respect to the second cleaning brush roller 106.

<Conditions of Second Scraping Blade 108>

Material: SUS.

Thickness: 100 μm.

Blade contact angle: 20 degrees.

Blade contact depth with second toner collection roller 107: 0.6 mm.

Application voltage (second scraping bias) to second scraping blade: −1200V.

Figure 18:
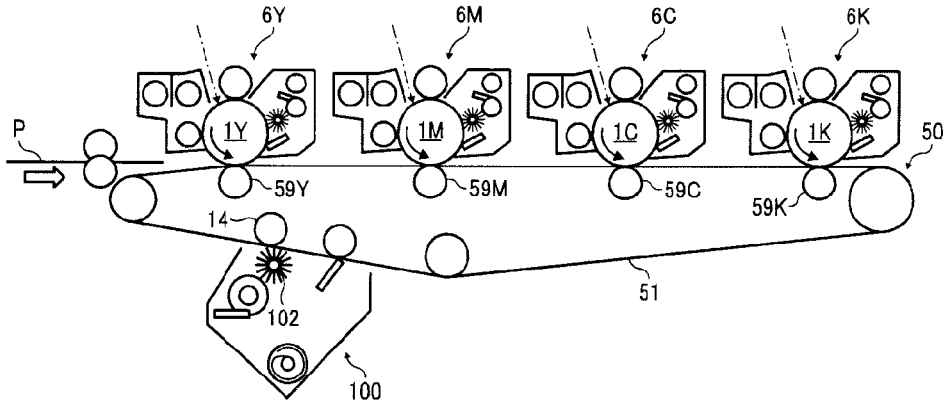
FIG. 18 is an enlarged view of a main part of an image forming apparatus according to a third modified embodiment.

FIG. 18 is a schematic configuration diagram illustrating an essential portion in a third modification of the image forming apparatus 1000 according to Exemplary Embodiment 1 of the present invention. In the third modification, a structure of a transfer unit 50 is different from the transfer unit 7 in Exemplary Embodiment 1 of the present invention. More specifically, the transfer unit 50 that serves as a belt device endlessly moves a transfer conveying belt 51 instead of moving an intermediate transfer belt such as the intermediate transfer belt 8 in FIG. 2 according to Exemplary Embodiment 1 of the present invention. Transfer rollers 59Y, 59M, 59C, and 59K for yellow, magenta, cyan, and black are arranged inside the loop of the transfer conveying belt 51. The transfer conveying belt 51 is sandwiched between the transfer rollers 59Y, 59M, 59C, and 59K and photoconductors 1Y, 1M, 1C, and 1K arranged outside the loop, at which the transfer nips for yellow, magenta, cyan, and black are formed.

A pair of registration rollers arranged on a left side of FIG. 18 with respect to the transfer unit 50 feeds a recording sheet P to an upper tensioned surface of the transfer conveying belt 51 with a predetermined timing. While the fed recording sheet P is attracted to the surface of the transfer conveying belt 51, the recording sheet P successively passes through the above-described transfer nip for yellow (Y), magenta (M), cyan (C), and black (K) according to movement of the transfer conveying belt 51. At this occasion, the Y, M, C, K toner images on the photoconductors 1Y, 1M, 1C, and 1K are transferred onto a surface of the recording sheet P in an overlapping manner in order.

After the recording sheet P passes through the primary transfer nip for black color arranged at the most downstream, the recording sheet P is separated from the surface of the transfer conveying belt 51, and the recording sheet P is fed to a fixing device, not illustrated. After the recording sheet P is separated, the toner remaining on the belt surface is removed by the belt cleaning unit 100. The belt cleaning device 100 according to third modification has the same structure as the belt cleaning device 100 according to Exemplary Embodiment 1 of the present invention except that this belt cleaning unit 100 does not clean the intermediate transfer belt 8 but cleans the transfer conveying belt 51.

Next, a description is given of a more distinguishing structure added to the image forming apparatus 1000 according to Exemplary Embodiment 1 of the present invention. This structure is described as Exemplary Embodiment 2 of the present invention. Unless otherwise stated, the structure of the image forming apparatus 1000 according to Exemplary Embodiment 2 has the same structure as the image forming apparatus 1000 according to Exemplary Embodiment 1 of the present invention.

Figure 19:
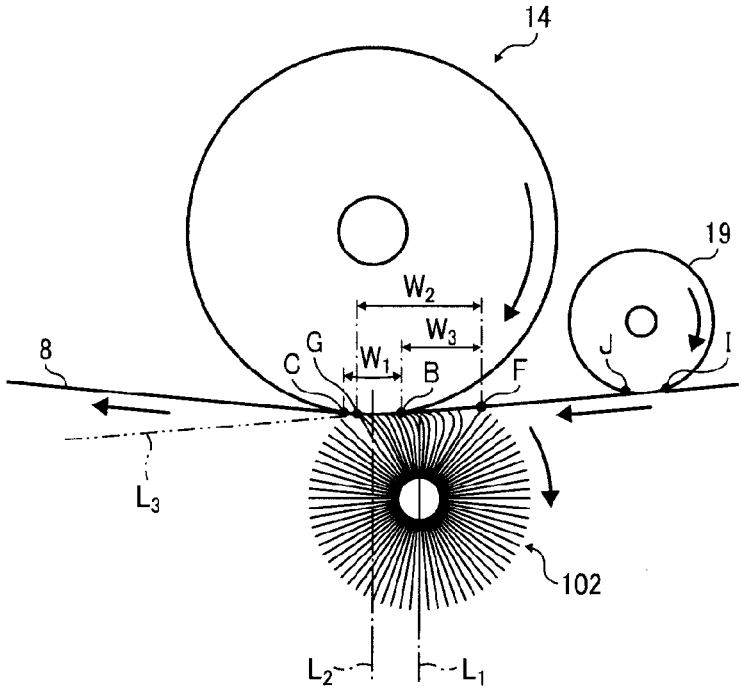
FIG. 19 is an enlarged view of a cleaning nip of the belt cleaning unit and components disposed around the belt cleaning unit of an image forming apparatus according to Exemplary Embodiment 2 of the present invention.

FIG. 19 is an enlarged configuration diagram illustrating a cleaning nip in the image forming apparatus 1000 according to Exemplary Embodiment 2 and components disposed around the cleaning nip. In a transfer unit in the image forming apparatus 1000 according to Exemplary Embodiment 2, an upstream cleaning tension roller 19 is arranged at an adjacent position at an upstream side in a belt moving direction of a tension roller 14 that is disposed adjacent to the upstream cleaning tension roller 19, and the intermediate transfer belt 8 is placed around and extended by the upstream cleaning tension roller 19. The upstream cleaning tension roller 19 is made of a hollow aluminum roller having a diameter of 14 mm, and presses, toward the cleaning brush roller 102, a tensioned belt area between the upstream cleaning tension roller 19 and the opposing roller 14. This pressing prevents a contact with the opposing roller 14 caused by ripples and consequent vibration of an upstream tensioned nip area (an area between a nip entrance point F and a tension entrance point B) which is an area within the cleaning nip and an area denoted as an upstream nip width $W_3$. This prevents an occurrence of cleaning failure caused by an excessive cleaning electric current flowing into the upstream tensioned nip area due to the above contact.

In the upstream cleaning tension roller 19, at least a surface of a roller portion thereof is made of an insulating member. More specifically, the roller portion is arranged with an insulating surface layer made of an insulating nylon tube (resistance=1E14 Ω·cm) having a thickness of 100 μm. A member made of a resin such as ABS, PP, and POM is used as a roller base body existing under the insulating surface layer of the roller portion. As described above, since the insulating surface layer is arranged on the roller portion of the upstream cleaning tension roller 19, it is possible to avoid a leak of electric current from the cleaning brush roller 102 to the upstream cleaning tension roller 19 via the intermediate transfer belt 8.

The intermediate transfer belt 8 is extended around a tensioned belt area, between a tension start point I and a tension end point J in FIG. 19, of the entire periphery of the roller portion of the upstream cleaning tension roller 19. In order to reliably prevent ripples and consequent vibration of the upstream tensioned nip area (an area between the nip entrance point F and the tension entrance point B), the tension end point J may be positioned at a downstream side in the belt moving direction with respect to the entrance point F of the cleaning nip. Even with this arrangement, an electric current does not leak from the cleaning nip to the upstream cleaning tension roller 19.

Next, a description is given of toner used in the image forming apparatus 1000 according to illustrative embodiments.

The toner used in the image forming apparatus 1000 according to illustrative embodiments preferably has a volume average particle diameter (Dn) of from 3 μm to 6 μm to reproduce microdots not less than 600 dpi. In addition, a ratio (Dv/Dn) of the volume average particle diameter (Dv) to the number of average particle diameter (Dn) of the toner is preferably in a range of from 1.00 to 1.40. As the ratio approaches 1.00, the particle diameter distribution becomes narrower. The toner having a smaller particle diameter and a narrower particle diameter distribution can be uniformly charged and transferred, and therefore high quality images without background fogging can be produced, and a higher transfer rate can be achieved in the image forming apparatus 1000 employing the electrostatic transfer system.

It is preferable that a shape factor "SF-1" of the toner used in each of the developing units 5Y, 5C, 5M, and 5K is in a range of from approximately 100 to approximately 180, and the shape factor "SF-2" of the toner used in each of the developing units 5Y, 5C, 5M, and 5K is in a range of from approximately 100 to approximately 180.

Referring to FIG. 19, the shape factor "SF-1" is a parameter representing the roundness of a particle.

The shape factor "SF-1" of a particle is calculated by a following Equation 1:

$$\text{SF-1}=\{(MXLNG)^2/\text{AREA}\}\times(100\pi/4) \qquad \text{Equation 1,}$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF-1" is 100, the particle has a perfect spherical shape. As the value of the "SF-1" increases, the shape of the particle becomes more elliptical.

Figure 20:
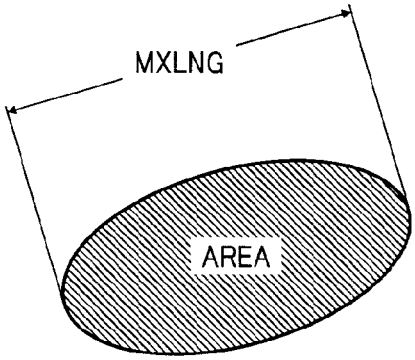
FIG. 20 is a schematic drawing of a toner having an "SF-1" shape factor.
Figure 21:
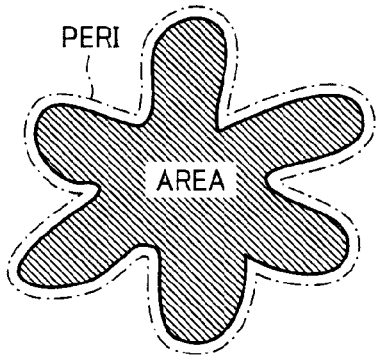
FIG. 21 is a schematic drawing of a toner having an "SF-2" shape factor.

Referring to FIG. 20, the shape factor "SF-2" is a value representing irregularity (i.e., a ratio of convex and concave portions) of the shape of the toner. The shape factor "SF-2" of a particle is calculated by a following Equation 2:

$$\text{SF-2}=\{(PERI)^2/\text{AREA}\}\times(100\pi/4) \qquad \text{Equation 2,}$$

where "PERI" represents the perimeter of a figure obtained by projecting a toner particle on a two dimensional plane.

When the value of the shape factor "SF-2" is 100, the surface of the toner is even (i.e., no convex and concave portions). As the value of the "SF-2" increases, the surface of the toner becomes uneven (i.e., the number of convex and concave portions increase).

In this embodiment, toner images are sampled by using a field emission type scanning electron microscope (FE-SEM) S-800 manufactured by HITACHI, LTD. The toner image information is analyzed by using an image analyzer (LUSEX3) manufactured by NIREKO, LTD.

As the toner shape becomes spherical, a toner particle becomes held in point-contact with another toner particle or the photoconductor 1. Under the above-described condition, the toner adhesion force between two toner particles may decrease, resulting in the increase in toner fluidity, and the toner adhesion force between the toner particle and the photoconductor 1 may decrease, resulting in the increase in toner transferability. And, the toner storing unit may easily collect reversely charge toner.

Further, considering collecting performance, it is preferable that the values of the shape factors "SF-1" and "SF-2" are 100 or greater. As the values of the shape factors "SF-1" and "SF-2" become greater, the toner charge distribution becomes greater and a load to the toner storing unit becomes greater. Therefore, the values of the shape factors "SF-1" and "SF-2" are preferable to be less than 180.

Further, a toner having a substantially spherical shape is preferably prepared by a method in which a toner composition including a polyester prepolymer having a function group including a nitrogen atom, a polyester, a colorant, and a releasing agent is subjected to an elongation reaction and/or a crosslinking reaction in an aqueous medium in the presence of fine resin particles.

Toner constituents and preferable manufacturing method of the toner of the prevent invention will be described below.

(Polyester)

Polyester is produced by the condensation polymerization reaction of a polyhydric alcohol compound with a polyhydric carboxylic acid compound.

As the polyhydric alcohol compound (PO), dihydric alcohol (DIO) and polyhydric alcohol (TO) higher than trihydric alcohol can be used. In particular, a dihydric alcohol DIO alone or a mixture of a dihydric alcohol DIO with a small amount of polyhydric alcohol (TO) is preferably used. Specific examples of the dihydric alcohol (DIO) include alkylene glycol such as ethylene glycol, 1,2-propylene glycol, 1,3-propylene glycol, 1,4-butanediol, 1,6-hexanediol; alkylene ether glycol such as diethylene glycol, triethylene glycol, dipropylene glycol, polyethylene glycol, polypropylene glycol, polytetramethylene ether glycol; alicyclic diol such as 1,4-cyclohexane dimethanol, hydrogenated bisphenol A; bisphenols such as bisphenol A, bisphenol F, bisphenol S; adducts of the above-mentioned alicyclic diol with an alkylene oxide such as ethylene oxide, propylene oxide, butylenes oxide; adducts of the above-mentioned bisphenol with an alkylene oxide such as ethylene oxide, propylene oxide, butylenes oxide. In particular, alkylene glycol having 2 to 12 carbon atoms and adducts of bisphenol with an alkylene oxide are preferably used, and a mixture thereof is more preferably used. Specific examples of the polyhydric alcohol (TO) higher than trihydric alcohol include multivalent aliphatic alcohol having tri-octa hydric or higher hydric alcohol such as glycerin, trimethylolethane, trimethylolpropane, pentaerythritol and sorbitol; phenol having tri-octa hydric or higher hydric alcohol such as trisphenol PA, phenolnovolak, cresolnovolak; and adducts of the above-mentioned polyphenol having tri-octa hydric or higher hydric alcohol with an alkylene oxide.

As the polycarboxylic acid (PC), dicarboxylic acid (DIC) and polycarboxylic acids having 3 or more valences (TC) can be used. A dicarboxylic acid (DIC) alone, or a mixture of the dicarboxylic acid (DIC) and a small amount of polycarboxylic acid having 3 or more valences (TC) is preferably used. Specific examples of the dicarboxylic acids (DIC) include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the polycarboxylic acid having 3 or more valences (TC) include aromatic polycarboxylic acids having 9 to 20 carbon atoms such as trimellitic acid and pyromellitic acid. The polycarboxylic acid (PC) can be formed from a reaction between the above-mentioned acids anhydride or lower alkyl ester such as methyl ester, ethyl ester and isopropyl ester.

The polyhydric alcohol (PO) and the polycarboxylic acid (PC) are mixed such that the equivalent ratio ([OH]/[COOH]) between the hydroxyl group [OH] of the poly hydric alcohol (PO) and the carboxylic group [COOH] of the polycarboxylic acid (PC) is typically from 2/1 to 1/1, preferably from 1.5/1 to 1/1 and more preferably from 1.3/1 to 1.02/1.

In the condensation polymerization reaction of a polyhydric alcohol (PO) with a polyhydric carboxylic acid (PC), the polyhydric alcohol (PO) and the polyhydric carboxylic acid (PC) are heated to a temperature from approximately 150° C. to approximately 280° C. in the presence of a known esterification catalyst, e.g., tetrabutoxy titanate or dibutyltineoxide. The generated water is distilled off with pressure being lowered, if necessary, to obtain a polyester resin containing a hydroxyl group. The hydroxyl value of the polyester resin is preferably 5 or more while the acid value of polyester is usually between 1 and 30, and preferably between 5 and 20. When a polyester resin having such an acid value is used, the residual toner is easily negatively charged. In addition, the affinity of the toner for recording paper can be improved, resulting in improvement of low temperature fixability of the toner. However, a polyester resin with an acid value above 30 can adversely affect stable charging of the residual toner, particularly when the environmental conditions vary.

The weight-average molecular weight of the polyester resin is from 10,000 to 400,000, and more preferably from 20,000 to 200,000. A polyester resin with a weight-average molecular weight between 10,000 lowers the offset resistance of the residual toner while a polyester resin with a weight-average molecular weight above 400,000 lowers the temperature fixability.

A urea-modified polyester is preferably included in the toner in addition to unmodified polyester produced by the above-described condensation polymerization reaction. The urea-modified polyester is produced by reacting the carboxylic group or hydroxyl group at the terminal of a polyester obtained by the above-described condensation polymerization reaction with a polyisocyanate compound (PIC) to obtain polyester prepolymer (A) having an isocyanate group, and then reacting the prepolymer (A) with amines to crosslink and/or extend the molecular chain.

Specific examples of the polyisocyanate compound (PIC) include aliphatic polyvalent isocyanate such as tetra methylenediisocyanate, hexamethylenediisocyanate, 2,6-diisocyanate methyl caproate; alicyclic polyisocyanate such as isophorondiisocyanate, cyclohexylmethane diisocyanate; aromatic diisocyanate such as tolylenediisocyanate, diphenylmethene diisocyanate; aroma-aliphatic diisocyanate such as α,α,α',α',-tetramethylxylene diisocynate; isocaynates; the above-mentioned isocyanates blocked with phenol derivatives, oxime, caprolactam; and a combination of two or more of them.

The polyisocyanate compound (PIC) is mixed such that the equivalent ratio ([NCO]/[OH]) between an isocyanate group [NCO] and a hydroxyl group [OH] of polyester having the isocyanate group and the hydroxyl group is typically from 5/1 to 1/1, preferably from 4/1 to 1.2/1, and more preferably from 2.5/1 to 1.5/1. A ratio of [NCO]/[OH] higher than 5 can deteriorate low-temperature fixability. As for a molar ratio of [NCO] below 1, if the urea-modified polyester is used, then the urea content in the ester is low, lowering the hot offset resistance.

The content of the constitutional unit obtained from a polyisocyanate (PIC) in the polyester prepolymer (A) is from 0.5% to 40% by weight, preferably from 1% to 30% by weight and more preferably from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-35) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than ½, molecular weight of the urea-modified polyester decreases, resulting in deterioration of hot offset resistance of the resultant toner.

Suitable polyester resins for use in the toner of the present invention may include a urea-modified polyesters. The urea-modified polyester may include a urethane bonding as well as a urea bonding. The molar ratio (urea/urethane) of the urea bonding to the urethane bonding is from 100/0 to 10/90, preferably from 80/20 to 20/80, and more preferably from 60/40 to 30/70. When the molar ratio of the urea bonding is less than 10%, hot offset resistance of the resultant toner deteriorates.

The urea modified polyester is produced by, for example, a one-shot method. Specifically, a polyhydric alcohol (PO) and a polyhydric carboxylic acid (PC) are heated to a temperature of approximately 150 degrees Celsius to approximately 280 degrees Celsius in the presence of the known esterification catalyst, e.g., tetrabutoxy titanate or dibutyltineoxide to be reacted. The resulting water is distilled off with pressure being lowered, if necessary, to obtain a polyester containing a hydroxyl group. Then, a polyisocyanate (PIC) is reacted with the polyester obtained above a temperature of from approximately 40 degrees Celsius to approximately 140 degrees Celsius to prepare a polyester prepolymer (A) having an isocyanate group. The prepolymer (A) is further reacted with an amine (B) at a temperature of from 0 degree Celsius to approximately 140 degrees Celsius to obtain a urea-modified polyester.

At the time of reacting the polyisocyanate (PIC) with a polyester and reacting the polyester prepolymer (A) with the amines (B), a solvent may be used, if necessary. Specific examples of the solvent include solvents inactive to the isocyanate (PIC), e.g., aromatic solvents such as toluene, xylene; ketones such as acetone, methyl ethyl ketone, methyl isobutyl ketone; esters such as ethyl acetate; amides such as dimethyl formamide, dimethyl acetatamide; and ethers such as tetrahydrofuran.

If necessary, a reaction terminator may be used for the crosslinking reaction and/or extension reaction of a polyester prepolymer (A) with an amine (B), to control the molecular weight of the resultant urea-modified polyester. Specific examples of the reaction terminators include a monoamine such as diethylamine, dibutylamine, butylamine, lauryl amine, and blocked substances thereof such as a ketimine compound.

The weight-average molecular weight of the urea-modified polyester is not less than 10,000, preferably from 20,000 to 10,000,000 and more preferably from 30,000 to 1,000,000. A molecular weight of less than 10,000 deteriorates the hot offset resisting property. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester alone but also the unmodified polyester resin can be included with the urea-modified polyester. A combination thereof improves low temperature fixability of the resultant toner and glossiness of color images produced by the image forming apparatus 100, and using the combination is more preferable than using the urea-modified polyester alone. It is noted that the unmodified polyester may contain polyester modified by a chemical bond other than the urea bond.

It is preferable that the urea-modified polyester at least partially mixes with the unmodified polyester resin to improve the low temperature fixability and hot offset resistance of the resultant toner. Therefore, the urea-modified polyester preferably has a structure similar to that of the unmodified polyester resin.

A mixing ratio between the urea-modified polyester and polyester resin is from 20/80 to 95/5 by weight, preferably from 70/30 to 95/5 by weight, more preferably from 75/25 to 95/5 by weight, and even more preferably from 80/20 to 93/7 by weight. When the weight ratio of the urea-modified polyester is less than 5%, the hot offset resistance deteriorates, and in addition, it is difficult to impart a good combination of high temperature preservability and low temperature fixability of the toner.

The toner binder preferably has a glass transition temperature (Tg) of from 45 degrees Celsius to 65 degrees Celsius, and preferably from 45 degrees Celsius to 60 degrees Celsius. When the glass transition temperature is less than 45 degrees Celsius., the high temperature preservability of the toner deteriorates. When the glass transition temperature is higher than 65 degrees Celsius., the low temperature fixability deteriorates.

Since the urea-modified polyester can exist on the surfaces of the mother toner particles, the toner of the present invention has better high temperature preservability than conventional toners including a polyester resin as a binder resin even though the glass transition temperature is low.

Here, the colorant, charge controlling agent, release agent, external additive, and the like can be prepared by using conventional materials.

(Colorant)

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, red iron oxide, red lead, orange lead, cadmium red, cadmium mercury red, antimony orange, Permanent Red 4R, Para Red, Fire Red, p-chloro-o-nitroaniline red, LitholFast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, Pigment Green B, Naphthol Green B, Green Gold, titanium oxide, zinc oxide, lithopone and the like. These materials are used alone or in combination.

A content of the colorant in the toner is preferably from 1% to 15% by weight, and more preferably from 3% to 10% by weight, based on total weight of the toner.

The colorant for use in the present invention can be combined with a resin to be used as a master batch. Specific examples of the resin for use in the master batch include, but are not limited to, styrene polymers and substituted styrene polymers (e.g., polystyrenes, poly-p-chlorostyrenes, and polyvinyltoluenes), copolymers of vinyl compounds and the above-described styrene polymers or substituted styrene polymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

(Charge Controlling Agent)

The toner of the present invention may optionally include a charge controlling agent.

Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto.

Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among the above-described examples, materials negatively charging the toner are preferably used.

The content of the charge controlling agent is determined depending on the species of the binder resin used, and toner manufacturing method (such as dispersion method) used, and is not particularly limited. However, the content of the charge controlling agent is typically from 0.1 parts by weight to 10 parts by weight, and preferably from 0.2 parts by weight to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and image density of the toner images.

(Release Agent)

A wax for use in the toner as a release agent has a low melting point of from 50° C. to 120° C. When such a wax is included in the toner, the wax is dispersed in the binder resin and serves as a release agent at a location between a fixing roller and the toner particles. Accordingly, hot offset resistance can be improved without applying a release agent, such as oil, to the fixing roller. Specific examples of the release agent include natural waxes including vegetable waxes such as carnauba wax, cotton wax, Japan wax and rice wax; animal waxes such as bees wax and lanolin; mineral waxes such as ozokelite and ceresine; and petroleum waxes such as paraffin waxes, microcrystalline waxes, and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes, and ether waxes. Further, fatty acid amides such as 1,2-hydroxylstearic acid amide, stearic acid amide, and phthalic anhydride imide; and low molecular weight crystalline polymers such as acrylic homopolymer and copolymers having a long alkyl group in their side chain such as poly-n-stearyl methacrylate, poly-n-laurylmethacrylate, and n-stearyl acrylate-ethyl methacrylate copolymers can also be used.

The above-described charge control agents and release agents can be dissolved and dispersed after kneaded upon application of heat together with a master batch pigment and a binder resin, and can be added when directly dissolved or dispersed in an organic solvent.

(External Additives)

The toner particles are preferably mixed with an external additive to assist in improving the fluidity, developing property and charging ability of the toner particles. Preferable external additives include inorganic fine particles. The inorganic fine particles preferably have a primary particle diameter of from $5\times10^{-3}$ to 2 μm, and more preferably from $5\times10^{-3}$ to 0.5 μm. In addition, the inorganic fine particles preferably has a specific surface area measured by a BET method of from 20 to 500 $m^2/g$. The content of the external additive is preferably from 0.01 to 5% by weight, and more preferably from 0.01% by weight to 2.0% by weight, based on total weight of the toner composition.

Specific examples of the inorganic fine particles include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among the above-described examples, a combination of a hydrophobic silica and a hydrophobic titanium oxide is preferably used. In particular, the hydrophobic silica and the hydrophobic titanium oxide each having an average particle diameter of not greater than $5\times10^{-4}$ μm considerably improves an electrostatic force between the toner particles and van der Waals force. Accordingly, the resultant toner composition has a proper charge quantity. In addition, even when the toner composition is agitated in the developing device, the external additive is hardly released from the toner particles. As a result, image defects such as white spots and image omissions are hardly produced. Further, the amount of the toner particles remaining on the photoconductive drum 15 after transfer can be reduced.

When titanium oxide fine particles are used as the external additive, the resultant toner can reliably form toner images having a proper image density even when environmental conditions are changed. However, the charge rising properties of the resultant toner tend to deteriorate. Therefore, an additive amount of the titanium oxide fine particles is preferably smaller than that of silica fine particles.

The total additive amount of hydrophobic silica fine particles and hydrophobic titanium oxide fine particles is preferably from 0.3% by weight to 1.5% by weight based on weight of the toner particles to reliably form higher-quality images without degrading charge rising properties even when images are repeatedly formed.

A method for manufacturing the toner is described in detail below, but is not limited thereto.

(Method for Manufacturing Toner)

(1) The colorant, the unmodified polyester, the polyester prepolymer having an isocyanate group, and the release agent are dispersed in an organic solvent to obtain toner constituent liquid. From the viewpoint of easy removal after formation of parent toner particles, it is preferable that the organic solvent be volatile and have a boiling point of not greater than 100 degrees Celsius. Specific examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, and methylisobutylketone. The above-described materials can be used alone or in combination. In particular, aromatic solvent such as toluene and xylene, and chlorinated hydrocarbon such as methylene chloride, 1,2-dichloroethane, chloroform, and carbon tetrachloride are preferably used. The toner constituent liquid preferably includes the organic solvent in an amount of from 0 part by weight to 300 parts by weight, more preferably from 0 part by weight to 100 parts by weight, and even more preferably from 25 parts by weight to 70 parts by weight based on 100 parts by weight of the prepolymer.

(2) The toner constituent liquid is emulsified in an aqueous medium under the presence of a surfactant and a particulate resin. The aqueous medium may include water alone or a mixture of water and an organic solvent. Specific examples of the organic solvent include alcohols such as methanol, isopropanol, and ethylene glycol; dimethylformamide; tetrahydrofuran; cellosolves such as methyl cellosolve; and lower ketones such as acetone and methyl ethyl ketone.

The toner constituent liquid includes the aqueous medium in an amount of from 50 parts by weight to 2,000 parts by weight, and preferably from 100 parts by weight to 1,000 parts by weight based on 100 parts by weight of the toner constituent liquid. When the amount of the aqueous medium is less than 50 parts by weight, the toner constituent liquid is not well dispersed and toner particles having a predetermined particle diameter cannot be formed. By contrast, when the amount of the aqueous medium is greater than 2,000 parts by weight, production costs increase.

A dispersant such as a surfactant or an organic particulate resin is optionally included in the aqueous medium to improve the dispersion therein.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives, and imidazoline) and quaternary ammonium salts (e.g., alkyltrimethyl ammonium salts, dialkyldimethyl ammonium salts, alkyldimethyl benzyl ammonium salts, pyridinium salts, alkyl isoquinolinium salts, and benzethonium chloride); nonionic surfactants such as fatty acid amide derivatives and polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can achieve a dispersion having high dispersibility even when a smaller amount of the surfactant is used. Specific examples of anionic surfactants having a fluoroalkyl group include fluoroalkyl carboxylic acids having from 2 carbon atoms to 10 carbon atoms and their metal salts, disodium perfluorooctanesulfonylglutamate, sodium 3-[ω-fluoroalkyl(C6-C11)oxy]-1-alkyl(C3-C4) sulfonate, sodium-[ω-fluoroalkanoyl(C6-C8)-N-ethylamino]-1-propane sulfonate, fluoroalkyl(C11-C20) carboxylic acids and their metal salts, perfluoroalkylcarboxylic acids (C7-C13) and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, and monoperfluoroalkyl(C6-C16)ethylphosphates.

Specific examples of commercially available surfactants include SURFLON® S-111, SURFLON® S-112, and SUR- FLON® S-113 manufactured by ASAHI GLASS CO., LTD.; FRORARD FC-93, FC-95, FC-98, and FC-129 manufactured by SUMITOMO 3M LTD.; UNIDYNE DS-101 and DS-102 manufactured by DAIKIN INDUSTRIES, LTD.; MEGAFACE F-110, F-120, F-113, F-191, F-812, and F-833 manufactured by DAINIPPON INK AND CHEMICALS, INC.; EFTOP EF-102, EF-103, EF-104, EF-105, EF-112, EF-123A, EF-123B, EF-306A, EF-501, EF-201, and EF-204 manufactured by TOHCHEM PRODUCTS CO., LTD.; and FUTARGENT F-100 and F-150 manufactured by NEOS CO., LTD.

Specific examples of cationic surfactants include primary and secondary aliphatic amines or secondary amino acid having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, and imidazolinium salts. Specific examples of commercially available products thereof include SURFLON® S-121 manufactured by ASAHI GLASS CO., LTD.; FRORARD FC-135 manufactured by SUMITOMO 3M LTD.; UNIDYNE DS-202 manufactured by DAIKIN INDUSTRIES, LTD.; MEGAFACE F-150 and F-824 manufactured by DAINIPPON INK AND CHEMICALS, INC.; EFTOP EF-132 manufactured by TOHCHEM PRODUCTS CO., LTD.; and FUTARGENT F-300 manufactured by NEOS Co., Ltd.

The resin particles are added to stabilize parent toner particles formed in the aqueous medium. Therefore, the resin particles are preferably added so as to have a coverage of from 10% to 90% over a surface of the parent toner particles. Specific examples of the resin particles include polymethylmethacrylate particles having a particle diameter of 1 μm and 3 μm, polystyrene particles having a particle diameter of 0.5 μm and 2 μm, and poly(styrene-acrylonitrile) particles having a particle diameter of 1 μm. Specific examples of commercially available products thereof include PB-200H manufactured by Kao Corporation, SGP manufactured by SOKEN CHEMICAL & ENGINEERING CO., LTD., Technopolymer SB manufactured by SEKISUI PLASTICS CO., LTD., SGP-3G manufactured by SOKEN CHEMICAL & ENGINEERING CO., LTD., and Micropearl from SEKISUI PLASTICS CO., LTD.

In addition, inorganic dispersants such as tricalcium phosphate, calcium carbonate, titanium oxide, colloidal silica, and hydroxy apatite can also be used.

As dispersants which can be used in combination with the above-described resin particles and inorganic dispersants, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid, and maleic anhydride), (meth)acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, and N-methylolmethacrylamide), vinyl alcohol and its ethers (e.g., vinyl methyl ether, vinyl ethyl ether, and vinyl propyl ether), esters of vinyl alcohol with a compound having a carboxyl group (e.g., vinyl acetate, vinyl propionate, and vinyl butyrate), acrylic amides (e.g., acrylamide, methacrylamide, and diacetoneacrylamide) and their methylol compounds, acid chlorides (e.g., acrylic acid chloride and methacrylic acid chloride), nitrogen-containing compounds (e.g., vinyl pyridine, vinyl pyrrolidone, vinyl imidazole, and ethylene imine), and homopolymer or copolymer having heterocycles of the nitrogen-containing compounds. In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds (e.g., methyl cellulose, hydroxyethyl cellulose, and hydroxypropyl cellulose) can also be used as the polymeric protective colloid.

The dispersion method is not particularly limited, and well-known methods such as low speed shearing methods, high-speed shearing methods, friction methods, high-pressure jet methods, and ultrasonic methods can be used. Among the above-described methods, the high-speed shearing methods are preferably used because particles having a particle diameter of from 2 μm to 20 μm can be easily prepared. When a high-speed shearing type dispersion machine is used, the rotation speed is not particularly limited, but the rotation speed is typically from 1,000 rpm to 30,000 rpm, and preferably from 5,000 rpm to 20,000 rpm. The dispersion time is not particularly limited, but is typically from 0.1 minutes to 5 minutes for a batch method. The temperature in the dispersion process is typically from 0 degrees Celsius to 150 degrees Celsius (under pressure), and preferably from 40 degrees Celsius to 98 degrees Celsius.

(3) While the emulsion is prepared, amines (B) are added thereto to react with the polyester prepolymer (A) having an isocyanate group. This reaction is accompanied by cross-linking and/or elongation of a molecular chain. The reaction time depends on reactivity of an isocyanate structure of the polyester prepolymer (A) and amines (B), but is typically from 10 minutes to 40 hours, and preferably from 2 to 24 hours. The reaction temperature is typically from 0 degree Celsius to 150 degrees Celsius, and preferably from 40 degrees Celsius to 98 degrees Celsius. In addition, a known catalyst such as dibutyltinlaurate and dioctyltinlaurate can be used as needed.

(4) After completion of the reaction, the organic solvent is removed from the emulsified dispersion (a reactant), and subsequently, the resulting material is washed and dried to obtain a parent toner particle. The prepared emulsified dispersion is gradually heated while stirred in a laminar flow, and an organic solvent is removed from the dispersion after stirred strongly when the dispersion has a specific temperature to form a parent toner particle having the shape of a spindle. When an acid such as calcium phosphate or a material soluble in alkaline is used as a dispersant, the calcium phosphate is dissolved with an acid such as a hydrochloric acid, and washed with water to remove the calcium phosphate from the parent toner particle. Besides the above-described method, the organic solvent can also be removed by an enzymatic hydrolysis.

(5) A charge control agent is provided to the parent toner particle, and inorganic fine particles such as silica fine particles and titanium oxide fine particles are added thereto to obtain toner. Well-known methods using a mixer or the like are used to provide the charge control agent and to add the inorganic fine particles.

Accordingly, toner having a smaller particle diameter and a sharper particle diameter distribution can be easily obtained. Further, the strong agitation in the process of removing the organic solvent can control the toner to have a shape between a spherical shape and a spindle shape, and a surface morphology between a smooth surface and a rough surface.

Further, the toner used in the image forming apparatus 1000 may be substantially spherical.

Figure 22A:
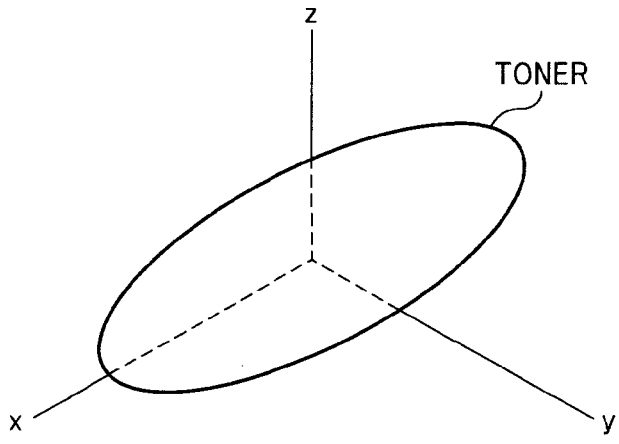
FIG. 22A is an outer shape of a toner used in the image forming apparatuses according to an exemplary embodiment of the present invention.
Figure 22B:
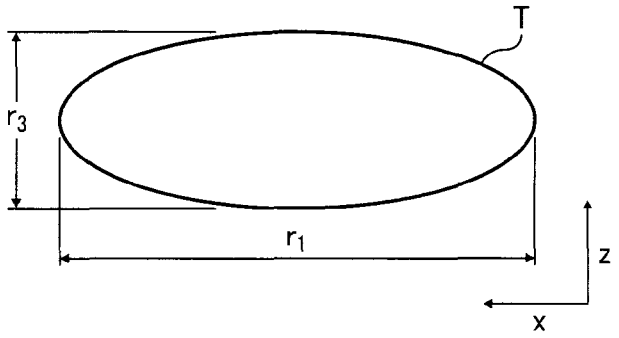
FIG. 22B is a schematic cross-sectional view of the toner, showing major and minor axes and a thickness of FIG. 11A.
Figure 22C:
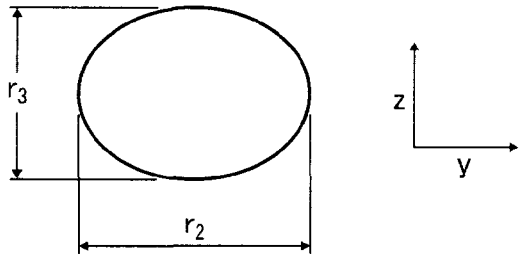
FIG. 22C is a schematic cross-sectional view of the toner, showing major and minor axes and a thickness of FIG. 11A.

Referring to FIGS. 22A, 22, and 22C, sized of the toner is described. An axis "x" of FIG. 22A represents a major axis "r1" of FIG. 22B, which is the longest axis of the toner. An axis "y" of FIG. 22A represents a minor axis "r2" of FIG. 11E, which is the second longest axis of the toner. The axis "z" of FIG. 22A represents a thickness "r3" of FIG. 22B, which is a thickness of the shortest axis of the toner. The toner has a relationship between the major and minor axes "r1" and "r2" and the thickness "r3" as follows:

$$r1 \geq r2 \geq r3.$$

The toner of FIG. 22A is preferably in a spindle shape in which the ratio (r2/r1) of the major axis "r1" to the minor axis "r2" is approximately 0.5 to approximately 1.0, and the ratio (r3/r2) of the thickness "r3" to the minor axis "r2" is approximately 0.7 to approximately 1.0.

When the ratio (r2/r1) is less than approximately 0.5, the toner has an irregular particle shape, and the value of the toner charge distribution increases.

When the ratio (r3/r2) is less than approximately 0.7, the toner has an irregular particle shape, and the value of the toner charge distribution increases. When the ratio (r3/r2) is approximately 1.0, the toner has a substantially round shape, and the value of the toner charge distribution decreases.

The lengths showing with "r1", "r2" and "r3" can be monitored and measured with scanning electron microscope (SEM) by taking pictures from different angles.

The charging amount of toner per a unit weight (Q/M) and the distribution of the charging amount of toner are measured as follows. The polarity control rate was also defined as follows.

<Toner Q/M>

An electrostatic solid image having a predetermined image proportion (hereinafter, a toner patch pattern) is formed on the photoconductor 1, followed by developing, transferring and cleaning. After completion of these processes, the switch of the image forming apparatus 1000 is forcibly turned off. Then, the toner particles remaining on the surface of the photoconductor 1 are sucked using an air pump. The charging amount of the collected toner particles is measured with a coulomb meter (ELECTROMETER 617 (trademark) from Keithley Instruments Inc.) to determine the charging amount (Q/M) of the toner per a unit weight (μC/g).

<Distribution of Charging Amount of Toner>

The distribution of charging amount of toner was measured with E-SPART Analyzer manufactured by Hosokawa Micron Corporation. Residual toner remaining on the surface of the photoconductor 1 is blown by air to fall on a measurement portion of the instrument so as to measure a diameter and charging amount of each toner particle. The calculation results were plotted in a graph, which are the charging amount per toner particle in the X-axis and the frequency (%) obtained by dividing the number of obtained charging amount per toner particle in bar area of histogram (unit) by total of samples (unit) and then multiplied by 100.

<Polarity Control Rate>

The polarity control rate was determined based on the measurement data of the above-described distribution of charging amount of toner. That is, the polarity control rate (%) was obtained by dividing the number of toner having a target polarity to be controlled (unit) by total of samples (unit) and then multiplied by 100. The "target polarity to be controlled" means a relative polarity of the voltage applied to a polarity control member when compared to the surface potential of a photoconductor. For example, when the surface potential of a photoconductor is −100V and the applied voltage of a polarity control member is −700V, toner is targetedly controlled to a negative polarity. When performing the above-described electrostatic cleaning method with toner polarity control and single polarity applying brush, it is important that the toner particles applied to a cleaning brush roller have all the same polarity. In other words, it is important that the above-described method obtains high polarity control rates.

As described above, in the image forming apparatus 1000 according to Exemplary Embodiments 1 and 2 of the present invention, the nip center line L1 that corresponds to the center line of the cleaning nip in the belt moving direction is located upstream from the belt wound area (the arc BC) with respect to the opposing roller 14 on the intermediate transfer belt 8. Accordingly, as described above, the image forming apparatus 1000 according to Exemplary Embodiments 1 and 2 of the present invention can remove almost all residual toner remaining on the intermediate transfer belt 8 to the brush portion 102B of the cleaning brush roller 102 by using the cleaning electric current before the residual toner is charged to the opposite polarity.

Further, in the image forming apparatus 1000 according to Exemplary Embodiments 1 and 2 of the present invention, the cleaning brush roller 102 contacts the belt would area (the arc BC) in the vicinity of the downstream end of the cleaning nip in the belt moving direction. Accordingly, as described above, the image forming apparatus 1000 according to Exemplary Embodiments 1 and 2 of the present invention can prevent occurrence of ripples and consequent vibration caused by abutting the cleaning brush roller 102 against the belt tensioned area at the nip exit point G.

Further, in the image forming apparatus 1000 according to Exemplary Embodiment 2 of the present invention, the upstream cleaning tension roller 19 presses the tensioned belt area formed between the upstream cleaning tension roller 19 and the opposing roller 14 toward the cleaning brush roller 102. With this configuration, as described above, a contact with the opposing roller 14 caused by ripples and consequent vibration of the upstream tensioned nip area (the area the nip entrance point F and the tension entrance point B) can be prevented. This can also prevent an occurrence of cleaning failure caused by an excessive cleaning electric current flowing into the upstream tensioned nip area due to the above-described contact.

Further, in the image forming apparatus 1000 according to Exemplary Embodiment 2 of the present invention, the upstream cleaning tension roller 19 includes an insulating member, at least a surface of a roller portion thereof is insulated. Therefore, as described above, it is possible to avoid a leak of electric current from the cleaning brush roller 102 to the upstream cleaning tension roller 19 via the intermediate transfer belt 8.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present patent application are possible in light of the above teachings. It is therefore to be understood that, the invention may be practiced otherwise than as specifically described herein.

What is claimed is:

1. A belt device, comprising:

an endless belt to rotate in a belt moving direction;

multiple belt tension rollers disposed in contact with an inner surface of the endless belt to tension the endless belt from inside a loop into which the endless belt is formed;

a device which contacts the endless belt and charges particles on the belt to a regular charging polarity of residual toner on the belt;

a rotary cleaning member, downstream of the device, to contact the endless belt opposite one of the multiple belt tension rollers at an outer surface of the endless belt to form a cleaning nip between the rotary cleaning member and the outer surface of the endless belt, the rotary cleaning member rotating its outer surface in a direction opposite the belt moving direction within the cleaning nip to remove residual toner remaining on an outer surface of the endless belt, the rotary cleaning member having a voltage applied thereto which is opposite to the regular charging polarity; and a toner collection roller, contacting the rotary cleaning member, having a voltage applied thereto which is opposite to the regular charging polarity and has a larger magnitude than the voltage applied to the rotary cleaning member, wherein the multiple belt tension rollers include an upstream tension roller disposed upstream from and adjacent to the belt tension roller disposed opposite the rotary cleaning member in the belt moving direction to press a tensioned belt area between the upstream tension roller and the opposing roller disposed opposite the rotary cleaning member against the rotary cleaning member, and wherein the upstream tension roller includes an insulating member at least partially covering a surface of the upstream tension roller.

2. The belt device according to claim 1, wherein the rotary cleaning member includes a cleaning brush roller comprising:

a rotary shaft for cleaning; and a brush portion formed by multiple fibrous members attached to an outer circumferential surface of the rotary shaft.

3. An image forming apparatus, comprising:

at least a toner image forming unit to form a toner image on a surface of an endless belt; and the belt device according to claim 1.

4. The image forming apparatus according to claim 3, wherein the image forming apparatus is configured to use toner containing particles having a volume-based average particle diameter from approximately 3 μm to approximately 6 μm and a distribution of from approximately 1.00 to approximately 1.40.

5. The image forming apparatus according to claim 3, wherein the image forming apparatus is configured to use toner containing particles having a shape factor SF-1 in a range of from approximately 100 to approximately 180, and a shape factor SF-2 in a range of from approximately 100 to approximately 180.

6. The image forming apparatus according to claim 3, wherein the endless belt comprises a base member including an elastic material.

7. The belt device according to claim 1, wherein the device which contacts the endless belt is a blade.

8. The belt device according to claim 7, wherein one of the multiple belt tension rollers is positioned such that the said device which contacts presses the endless belt against said one of the multiple belt tension rollers.

9. The belt device according to claim 1, wherein one of the multiple belt tension rollers is positioned such that the device which contacts presses the endless belt against said one of the multiple belt tension rollers.

10. The belt device according to claim 1, further comprising:

a second rotary cleaning member, downstream of said rotary cleaning member, to contact the endless belt at an outer surface of the endless belt to form a second cleaning nip between the rotary cleaning member and the outer surface of the endless belt, the second rotary cleaning member rotating its outer surface in a direction opposite the belt moving direction within the cleaning nip to remove residual toner remaining on an outer surface of the endless belt, the second rotary cleaning member having a voltage applied thereto which has the regular charging polarity; and a second toner collection roller, contacting the second rotary cleaning member, which collects toner from the second rotary cleaning member.

* * * * *